US010451305B2

(12) United States Patent
Motomura

(10) Patent No.: US 10,451,305 B2
(45) Date of Patent: Oct. 22, 2019

(54) AIR-CONDITIONING APPARATUS

(71) Applicant: Mitsubishi Electric Corporation, Tokyo (JP)

(72) Inventor: Yuji Motomura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 36 days.

(21) Appl. No.: 15/755,150

(22) PCT Filed: Oct. 26, 2015

(86) PCT No.: PCT/JP2015/080111
§ 371 (c)(1),
(2) Date: Feb. 26, 2018

(87) PCT Pub. No.: WO2017/072831
PCT Pub. Date: May 4, 2017

(65) Prior Publication Data

US 2018/0259219 A1 Sep. 13, 2018

(51) Int. Cl.
*F24F 11/83* (2018.01)
*F25B 39/02* (2006.01)
(Continued)

(52) U.S. Cl.
CPC ..... *F24F 11/83* (2018.01); *F24F 1/0007* (2013.01); *F24F 5/0007* (2013.01); *F24F 11/84* (2018.01);
(Continued)

(58) Field of Classification Search
CPC ..... F25B 39/028; F25B 2313/0314; F25B 2313/0315; F25B 2500/19;
(Continued)

(56) References Cited

U.S. PATENT DOCUMENTS 6,772,600 B2 * 8/2004 Hwang ..... F25B 13/00 62/160
8,800,319 B2 * 8/2014 Takayama ..... F25B 29/00 62/513
(Continued)

FOREIGN PATENT DOCUMENTS

CN 201569203 U 9/2010
CN 102483250 A 5/2012
(Continued)

OTHER PUBLICATIONS

International Search Report of the International Searching Authority dated Jan. 19, 2016 for the corresponding International application No. PCT/JP2015/080111 (and English translation).
(Continued)

*Primary Examiner* — Crystal J Barnes-Bullock
(74) *Attorney, Agent, or Firm* — Posz Law Group, PLC

(57) ABSTRACT

The air-conditioning apparatus includes: a refrigerant cycle circuit through which a heat source side refrigerant circulates; a plurality of heat medium cycle circuits through which a heat medium circulates, the plurality of heat medium cycle circuits including a plurality of use-side heat exchangers, the heat medium exchanging heat with the heat source side refrigerant of the refrigerant cycle circuit in intermediate heat exchangers; and a heat medium distribution device provided in one of the plurality of heat medium cycle circuits to which a plurality of the use-side heat exchangers are connected, the heat medium distribution device controlling flow rates of the heat medium of the plurality of use-side heat exchangers connected to the heat medium cycle circuit.

8 Claims, 6 Drawing Sheets

(51) Int. Cl.

| | |
|---|---|
| ***F25B 1/00*** | (2006.01) |
| ***F24F 11/89*** | (2018.01) |
| ***F24F 5/00*** | (2006.01) |
| ***F25B 13/00*** | (2006.01) |
| ***F25B 49/02*** | (2006.01) |
| ***F24F 11/84*** | (2018.01) |
| ***F24F 1/0007*** | (2019.01) |
| *F24F 140/20* | (2018.01) |

(52) U.S. Cl.
CPC ..... *F24F 11/89* (2018.01); *F25B 1/00* (2013.01); *F25B 13/00* (2013.01); *F25B 39/028* (2013.01); *F25B 49/02* (2013.01); *F24F 2140/20* (2018.01); *F25B 2313/003* (2013.01); *F25B 2313/007* (2013.01); *F25B 2313/0232* (2013.01); *F25B 2313/0272* (2013.01); *F25B 2313/02732* (2013.01); *F25B 2313/02741* (2013.01); *F25B 2313/0314* (2013.01); *F25B 2313/0315* (2013.01); *F25B 2500/19* (2013.01); *F25B 2600/2507* (2013.01); *F25B 2700/2104* (2013.01)

(58) Field of Classification Search
CPC ..... F25B 2600/2507; F25B 2700/2104; F24F 11/83; F24F 11/84; F24F 2140/50; B60H 1/00899; B60H 2001/00928
See application file for complete search history.

(56) References Cited

U.S. PATENT DOCUMENTS

| | | | | |
|---|---|---|---|---|
| 9,285,128 | B2 * | 3/2016 | Takata | F24F 1/68 |
| 9,459,033 | B2 * | 10/2016 | Tamaki | F25B 49/005 |
| 9,638,430 | B2 * | 5/2017 | Motomura | F25B 13/00 |
| 10,030,894 | B2 * | 7/2018 | Azuma | F24F 11/89 |
| 10,139,125 | B2 * | 11/2018 | Azuma | F24F 11/89 |
| 2008/0282728 | A1 * | 11/2008 | Takegami | F25B 1/10 62/498 |
| 2009/0095000 | A1 * | 4/2009 | Yoshimi | F25B 49/005 62/149 |
| 2011/0192184 | A1 | 8/2011 | Yamashita et al. | |
| 2012/0151949 | A1 | 6/2012 | Yamashita et al. | |
| 2016/0370042 | A1 * | 12/2016 | Onaka | F25B 5/02 |
| 2017/0122630 | A1 * | 5/2017 | Okazaki | F24F 11/89 |
| 2018/0156498 | A1 * | 6/2018 | Matsumoto | F25B 39/028 |
| 2018/0347868 | A1 * | 12/2018 | Okano | F24F 11/64 |

FOREIGN PATENT DOCUMENTS

| | | | | |
|---|---|---|---|---|
| EP | 2 899 477 | A1 | | 7/2015 |
| JP | 01203832 | A | * | 8/1989 |
| JP | H05-280818 | A | | 10/1993 |
| JP | 2001-289465 | A | | 10/2001 |
| JP | 2003-343936 | A | | 12/2003 |
| JP | 2005-140444 | A | | 6/2005 |
| JP | 2010-156478 | A | | 7/2010 |
| JP | 2013-160478 | A | | 8/2013 |
| JP | 2013-194975 | A | | 9/2013 |
| WO | 2010/049998 | A1 | | 5/2010 |
| WO | 2013/140954 | A1 | | 9/2013 |
| WO | 2014/045358 | A1 | | 3/2014 |

OTHER PUBLICATIONS

Office Action dated Sep. 2, 2019 issued in corresponding CN patent application No. 201580084002.6 (and English translation).

* cited by examiner

AIR-CONDITIONING APPARATUS

CROSS REFERENCE TO RELATED APPLICATION

This application is a U.S. national stage application of International Application No. PCT/JP2015/080111, filed on Oct. 26, 2015, the contents of which are incorporated herein by reference.

TECHNICAL FIELD

The present invention relates to an air-conditioning apparatus that is applied, for example, to a multi-air-conditioning apparatus for use in building or a similar apparatus.

BACKGROUND

Like multi-air-conditioning apparatuses for use in building, some air-conditioning apparatuses each include heat source unit (outdoor unit) disposed outside a building and an indoor unit disposed in a room of the building. Refrigerant circulating through a refrigerant circuit of such an air-conditioning apparatus rejects heat into (or removes heat from) air that is supplied to a heat exchanger of the indoor unit and thereby heats or cools the air. Then, the air thus heated or cooled is sent into an air-conditioned space so that heating or cooling is performed.

Adopted examples of heat source side refrigerants that are used in such air-conditioning apparatuses include many types of HFC (hydrofluorocarbon) refrigerant. Further, an example of heat source side refrigerant involves the use of a natural refrigerant such as carbon dioxide ($CO_2$).

Further, there have been proposed various types of air-conditioning apparatus each including, as heat source unit disposed outside a building, a chiller that generates cooling energy or heating energy (see, for example, Patent Literature 1). Patent Literature 1 discloses a technology with which to perform heating or cooling by heating or cooling a heat medium such as water or antifreeze with an intermediate heat exchanger disposed in the chiller and conveying the heat medium via heat medium pipes to a fan coil unit, a panel heater, or a similar device serving as an indoor unit (see, for example, Patent Literature 1).

Further, there has been proposed an air-conditioning apparatus, called an exhaust heat recovery chiller, having four heat medium pipes connected between heat source unit and an indoor unit (see, for example, Patent Literature 2). Patent Literature 2 discloses a technology with which to supply a heated heat medium and a cooled heat medium to the indoor unit simultaneously and allow a free choice of cooling or heating at the indoor unit.

Further, there has been proposed an air-conditioning apparatus including a primary side refrigerant circuit through which a primary refrigerant circulates and a secondary side refrigerant circuit through which a secondary refrigerant circulates, the secondary refrigerant serving as a heat medium, the secondary side refrigerant circuit including a use-side heat exchanger, wherein an intermediate heat exchanger that exchanges heat between the primary refrigerant and the secondary refrigerant is disposed near each indoor unit (see, for example, Patent Literature 3).

Further, there has been proposed an air-conditioning apparatus configured such that a heat source side refrigerant heated or cooled by an outdoor unit is supplied to an intermediate heat exchanger mounted in a branch unit and the heating energy or cooling energy of the heat source side refrigerant thus supplied is transferred to a heat medium via the intermediate heat exchanger (see, for example, Patent Literature 4). Patent Literature 4 discloses a technology with which an indoor unit and the branch unit are connected to each other by two heat medium pipes.

Further, there has been proposed an air-conditioning apparatus, such as a multi-air-conditioning apparatus for use in building, in which to, by circulating refrigerant from an outdoor unit to a relay unit and circulating a heat medium such as water from the relay unit to an indoor unit, circulate the heat medium such as water through the indoor unit and, at the same time, allow the heat medium to be conveyed with less power (see, for example, Patent Literature 5).

PATENT LITERATURE

Patent Literature 1: Japanese Unexamined Patent Application Publication No. 2005-140444

Patent Literature 2: Japanese Unexamined Patent Application Publication No. 5-280818

Patent Literature 3: Japanese Unexamined Patent Application Publication No. 2001-289465

Patent Literature 4: Japanese Unexamined Patent Application Publication No. 2003-343936

Patent Literature 5: International Publication No. 10/049998

In each of the technologies disclosed in Patent Literatures 1 to 5, one or more heat medium cycle circuits are constituted by one or more use-side heat exchangers being connected to an intermediate heat exchanger in parallel with one another. Moreover, each of the heat medium cycle circuits is provided with a flow control valve that is capable of controlling a heat medium flow rate, so that the heat medium cycle circuits can be different in heat medium flow rate from one another.

In each of the technologies disclosed in Patent Literatures 1 to 5, a single use-side heat exchanger is connected to each single heat medium cycle circuit. In an alternative configuration, a plurality of use-side heat exchangers may be connected to a single heat medium cycle circuit. Such a configuration in which a plurality of use-side heat exchangers are connected in a single circuit has not been configured to be able to control the respective flow rates of the use-side heat exchangers in that circuit. This has undesirably made control appropriate to heat loads impossible in a case where the use-side heat exchangers are different in capacity or heat load from one another.

SUMMARY

The present invention has been made in order to solve such a problem, and has as an object to provide an air-conditioning apparatus that makes it possible to control the flow rate of each of a plurality of use-side heat exchangers connected to a heat medium cycle circuit and thereby makes it possible to convey a heat medium to each of the use-side heat exchangers at a flow rate appropriate to a heat load of that use-side heat exchanger.

An air-conditioning apparatus according to an embodiment of the present invention includes: a refrigerant cycle circuit through which a heat source side refrigerant circulates, the refrigerant cycle circuit being constituted by connecting a compressor, a heat source side heat exchanger, an expansion device, and refrigerant side flow passages of a plurality of intermediate heat exchangers through refrigerant pipes; a plurality of heat medium cycle circuits through which a heat medium circulates, the plurality of heat medium cycle circuits being constituted by heat medium side flow passages of the plurality of intermediate heat exchangers, a plurality of heat medium conveying devices, and a plurality of use-side heat exchangers through heat medium pipes, a plurality of heat medium flow switching devices each of which being provided for each separate one of the plurality of heat medium cycle circuits, the heat medium flow switching devices configured to switch flow passages of the heat medium so that each of the use-side heat exchangers is connected to any of the plurality of intermediate heat exchangers, and a heat medium distribution device provided in one of the plurality of heat medium cycle circuits to which a plurality of the use-side heat exchangers are connected, the heat medium distribution device being configured to control flow rates of the heat medium of the plurality of use-side heat exchangers connected to the one of the heat medium cycle circuits.

According to an air-conditioning apparatus according to an embodiment of the present invention, the heat medium distribution device is provided in the heat medium cycle circuit to which the plurality of use-side heat exchangers are connected, and the heat medium distribution device makes it possible to control the flow rate of each of the use-side heat exchangers. This in turn makes it possible to convey the heat medium to each of the use-side heat exchangers at a flow rate appropriate to a heat load of that use-side heat exchanger.

DETAILED DESCRIPTION

The following describes Embodiment of the present invention with reference to the drawings.

Embodiment

Figure 1:
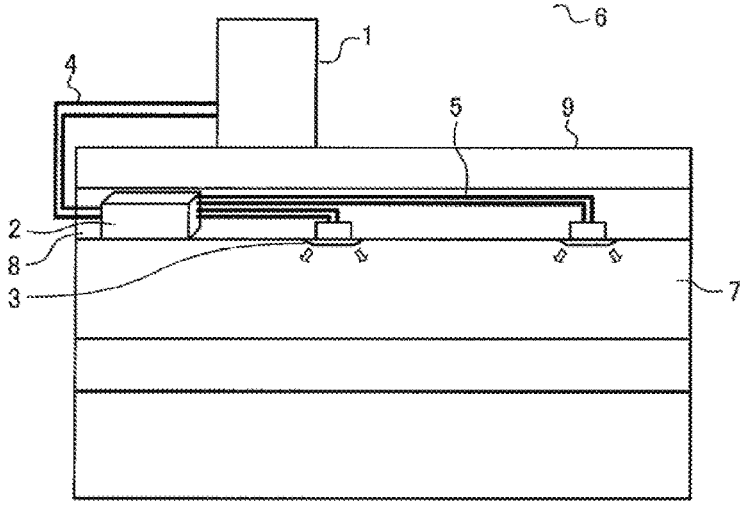
FIG. 1 is a schematic view showing an example of installation of an air-conditioning apparatus 100 according to Embodiment of the present invention.
Figure 2:
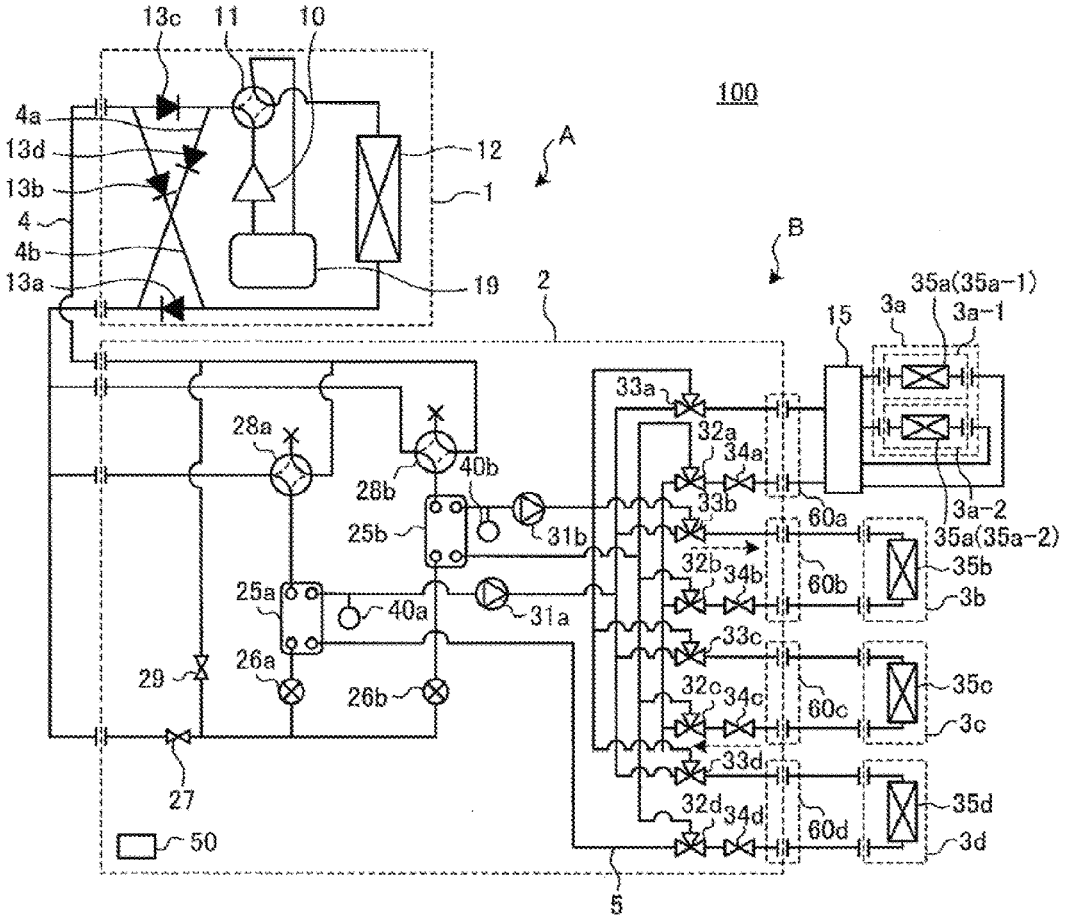
FIG. 2 is a diagram showing an example of a circuit configuration of an outdoor unit 1 and a relay unit 2 in the air-conditioning apparatus 100 according to Embodiment of the present invention.

FIG. 1 is a schematic view showing an example of installation of an air-conditioning apparatus 100 according to Embodiment of the present invention. FIG. 2 is a diagram showing an example of a refrigerant circuit configuration in the air-conditioning apparatus 100 according to Embodiment of the present invention.

As shown in FIG. 1, the air-conditioning apparatus 100 according to Embodiment includes an outdoor unit (heat source unit) 1, a plurality of indoor units 3 (3*a* to 3*d*), and a single relay unit 2 interposed between the outdoor unit 1 and the indoor units 3. Moreover, the air-conditioning apparatus 100 allows each of the indoor units 3 to choose cooling operation or heating operation.

The relay unit 2 exchanges heat between a heat source side refrigerant and a heat medium. The outdoor unit 1 and the relay unit 2 are connected to each other by refrigerant pipes 4 through which the heat source side refrigerant flows, and constitute a refrigerant cycle circuit A serving as a refrigeration cycle that circulates the heat source side refrigerant. The relay unit 2 and the indoor units 3 are connected to each other by heat medium pipes 5 through which the heat medium flows, and constitute a heat medium cycle circuit B that circulates the heat medium.

The relay unit 2 includes a plurality of connecting ports 60 where the relay unit 2 is connected to the indoor units 3. The indoor units 3 are connected to these connecting ports 60 via the heat medium pipes 5. It should be noted that constituent components, such as switching devices, which are connected to each of the refrigerant cycle circuit A and the heat medium cycle circuit B will be described later. Moreover, cooling energy or heating energy generated in the outdoor unit 1 is delivered to the indoor units 3 via the relay unit 2.

The air-conditioning apparatus 100 according to Embodiment allows one or more indoor units 3 to be connected to each of the connecting ports 60 (60*a* to 60*d*). Specifically, the indoor unit 3*a* includes two separate indoor units, namely, an indoor unit 3*a*-1 including use-side heat exchangers 35*a*-1, and an indoor unit 3*a*-2 including use-side heat exchangers 35*a*-2, and the two indoor units 3*a*-1 and 3*a*-2 are connected to the connecting port 60*a*. Further, a single indoor unit 3*b*, a single indoor unit 3*c*, and a single indoor unit 3*d* are connected to the connecting ports 60*b* to 60*d*, respectively. The indoor units 3*b* to 3*d* include use-side heat exchangers 35*b* to 35*d*, respectively.

Moreover, Embodiment is characterized in that connecting a heat medium distribution device 15 to the connecting port 60*a* makes it possible to control the flow rates of the heat medium with respect to the two indoor units 3*a*-1 and 3*a*-2 connected to the single connecting port 60*a*. That is, Embodiment is characterized in that the heat medium having flowed into the heat medium distribution device 15 circulates by optimally diverging into flows that go to the two indoor units 3*a*-1 and 3*a*-2, respectively, and then converge.

In the following, first, the outdoor unit 1, the relay unit 2, and the indoor units 3 are described. The heat medium distribution device 15 will be described later.

It should be noted that in a case where there is no particular need to specify that the indoor unit 3*a*, which is connected to the connecting port 60*a*, includes two indoor units, the following gives a description based on the assumption, for convenience of explanation, that the indoor unit 3*a* is the only indoor unit 3 that is connected to the connecting port 60*a* and a use-side heat exchanger 35*a* is the only use-side heat exchanger in the indoor unit 3*a*.

The outdoor unit 1 is usually disposed in an outdoor space 6, which is a space (e.g. a rooftop) outside a structure 9 such as a building, and supplies cooling energy or heating energy to the indoor units 3 via the relay unit 2.

The relay unit 2 transfers, to the indoor units 3, cooling energy or heating energy that is generated in the outdoor unit 1. This relay unit 2 is configured to be installable in a place different from the outdoor space 6 and an indoor space 7 as a housing separate from the outdoor unit 1 and the indoor units 3. Further, the relay unit 2 is connected to the outdoor unit 1 via the refrigerant pipes 4 and also connected to the indoor units 3 via the heat medium pipes 5.

The indoor units 3 are disposed in such positions as to be able to supply cooling air or heating air to the indoor space 7, which is a space (e.g. a living room) inside the structure 9, and supply cooling air or heating air to the indoor space 7, which is an air-conditioned space. Although FIG. 1 illustrates the indoor units 3 as those of a ceiling concealed type, this does not imply any limitation.

The heat source side refrigerant is conveyed from the outdoor unit 1 to the relay unit 2 through the refrigerant pipes 4. The heat source side refrigerant thus conveyed heats or cools the heat medium by exchanging heat with the heat medium in the after-mentioned intermediate heat exchangers 25*a* and 25*b* (see FIG. 2) of the relay unit 2. That is, the heat medium becomes hot water or cold water by being heated or cooled by the intermediate heat exchangers. The hot water or cold water produced in the relay unit 2 is conveyed to the indoor units 3 via the heat medium pipes 5 by the after-mentioned pumps 31*a* and 31*b* (see FIG. 2) and used by the indoor units 3 for heating operation or cooling operation on the indoor space 7.

Examples of the usable heat source side refrigerant include single refrigerants such as R-22 and R-134a, near-azeotropic refrigerant mixtures such as R-410A and R-404A, and non-azeotropic refrigerant mixtures such as R-407C. Other examples of the usable heat source side refrigerant include refrigerants, such as $CF_3$ and $CF{=}CH_2$, whose chemical formulas include double bonds and whose global warming potentials take on comparatively small values. Further examples of the usable heat source side refrigerant include a natural refrigerant such as $CO_2$ or propane.

Meanwhile, examples of the usable heat medium include water, brine (antifreeze), a liquid mixture of water and antifreeze, a liquid mixture of water and a highly anti-corrosive additive, and similar liquids. That is, by adopting any of these heat media, the air-conditioning apparatus 100 contributes to improvement in safety against leakage of the heat medium into the indoor space 7. It should be noted that the air-conditioning apparatus 100 according to Embodiment is described on the assumption that water is adopted as the heat medium.

As shown in FIG. 1, in the air-conditioning apparatus 100 according to Embodiment, the outdoor unit 1 and the relay unit 2 are connected to each other using two refrigerant pipes 4, and the relay unit 2 and each of the indoor units 3 are connected to each other using two heat medium pipes 5. Thus, the air-conditioning apparatus 100, in which each of the units (i.e. the outdoor unit 1, the relay unit 2, and the indoor units 3) is connected to the other using two pipes (i.e. refrigerant pipes 4 or heat medium pipes 5), facilitates the execution of work.

It should be noted that FIG. 1 shows, as an example, a state where the relay unit 2 is installed in a space, such as a space above a ceiling, which is a space inside the structure 9 that is different from the indoor space 7 (such a space being hereinafter simply referred to as "space 8"). Alternatively, the relay unit 2 may be installed in a shared space or a similar space in which an elevator or a similar machine is installed. Further, although FIG. 1 shows, as an example, a case where the indoor units 3 are of a ceiling cassette type, this does not imply any limitation. The indoor units 3 may be of any type, such as a ceiling concealed type or a ceiling suspend type, provided they are configured to blow out heating air or cooling air into the indoor space 7 either directly or through ducts.

Although FIG. 1 shows, as an example, a case where the outdoor unit 1 is installed in the outdoor space 6, this does not imply any limitation. For example, the outdoor unit 1 may be installed in an enclosed space such as a machine room provided with a ventilation hole or, if waste heat can be exhausted out of the structure 9 through an exhaust duct, may be installed inside the structure 9. Further, in a case where the outdoor unit 1 is of a water-cooled type, too, the outdoor unit 1 may be installed inside the structure 9. No special problem will occur even if the outdoor unit 1 is installed in such a place.

Further, the relay unit 2 may be installed near the outdoor unit 1. Note, however, that in a such a case where the relay unit 2 is installed near the outdoor unit 1, it is only necessary to keep in mind the lengths of the heat medium pipes 5 connecting the relay unit 2 to the indoor units 3. This is because increasing distance from the relay unit 2 to the indoor units 3 requires accordingly greater power to convey the heat medium and thereby impairs energy-saving effects.

Furthermore, the numbers of outdoor units 1, relay units 2, and indoor units 3 that are connected are not limited to the numbers illustrated in FIG. 1 but need only be determined according to the structure 9 in which the air-conditioning apparatus 100 is installed.

In a case where a plurality of relay units 2 are connected to a single outdoor unit 1, the plurality of relay units 2 can be scatteringly installed in a space such as a shared space or a space above a ceiling in a structure such as a building. Doing so makes it possible to cover air conditioning loads with the after-mentioned intermediate heat exchangers 25*a* and 25*b* (see FIG. 2) of each of the relay units 2. Further, indoor units 3 can be installed at a distance or height within an allowable range of conveyance of the pumps 31*a* and 31*b* (see FIG. 2) of each of the relay units 2 and can be disposed in the whole of a structure such as a building.

FIG. 2 is a diagram showing an example of a circuit configuration of the outdoor unit 1 and the relay unit 2 in the air-conditioning apparatus 100 according to Embodiment of the present invention.

As shown in FIG. 2, the outdoor unit 1 and the relay unit 2 are connected to each other by the refrigerant pipes 4 via the intermediate heat exchangers 25*a* and 25*b* of the relay unit 2. Further, the relay unit 2 and the indoor units 3 are connected to each other by the heat medium pipes 5 via the intermediate heat exchangers 25*a* and 25*b*. That is, each of the intermediate heat exchangers 25*a* and 25*b* has a refrigerant side flow passage and a heat medium side flow passage and exchanges heat between the heat source side refrigerant that is supplied to the refrigerant side flow passage via the refrigerant pipes 4 and the heat medium that is supplied to the heat medium side flow passage via the heat medium pipes 5.

[Outdoor Unit 1]

The outdoor unit 1 is mounted with a compressor 10, a first refrigerant flow switching device 11 such as a four-way valve, a heat source side heat exchanger 12, and an accumulator 19 that are connected to one another by the refrigerant pipes 4. Further, the outdoor unit 1 is provided with a first connecting pipe 4*a*, a second connecting pipe 4*b*, and check valves 13*a* to 13*d*. The provision of the first connecting pipe 4*a*, the second connecting pipe 4*b*, and the check valves 13*a* to 13*d* enables the air-conditioning apparatus 100 to allow the heat source side refrigerant to flow unidirectionally from the outdoor unit 1 into the relay unit 2 regardless of whether in a heating operation mode or a cooling operation mode.

The compressor 10 sucks refrigerant, compresses the refrigerant into a high-temperature and high-pressure state, and conveys the refrigerant to the refrigerant cycle circuit A. This compressor 10 has its discharge side connected to the first refrigerant flow switching device 11 and its suction side connected to the accumulator 19. The compressor 10 may be constituted, for example, by a capacity-controllable inverter compressor or a similar device.

The first refrigerant flow switching device 11 connects the discharge side of the compressor 10 to the check valve 13*d* and connects the heat source side heat exchanger 12 to a suction side of the accumulator 19 during a heating only operation mode and during a heating main operation mode of a cooling and heating mixed operation mode. Further, the first refrigerant flow switching device 11 connects the discharge side of the compressor 10 to the heat source side heat exchanger 12 and connects the check valve 13*c* to the suction side of the accumulator 19 during the cooling operation mode and during a cooling main operation mode of the cooling and heating mixed operation mode.

The heat source side heat exchanger 12 functions as an evaporator during heating operation and functions as a condenser (or a radiator) during cooling operation. Moreover, the heat source side heat exchanger 12 exchanges heat between a fluid of air that is supplied from an air-sending device such as a fan (not illustrated) and the heat source side refrigerant and either evaporates and gasifies or condenses and liquefies the heat source side refrigerant. This heat source side heat exchanger 12 has its first side connected to the check valve 13*b* and its second side connected to the suction side of the accumulator 19 during the heating operation mode. Further, the heat source side heat exchanger 12 has its first side connected to the discharge side of the compressor 10 and its second side connected to the check valve 13*a* during the cooling operation mode. The heat source side heat exchanger 12 may be constituted, for example, by such a plate-fin-and-tube heat exchanger as to be able to exchange heat between refrigerant flowing through a refrigerant pipe and air passing through a fin.

The accumulator 19 accumulates excess refrigerant resulting from a difference between the amount of refrigerant that is needed during the heating operation mode and the amount of refrigerant that is needed during the cooling operation mode and excess refrigerant resulting from a transient change in operation (e.g. a change in the number of operating indoor units 3). This accumulator 19 has its suction side connected to the heat source side heat exchanger 12 and its discharge side connected to the suction side of the compressor 10 during the heating operation mode. Further, the accumulator 19 has its suction side connected to the check valve 13*c* and its discharge side connected to the suction side of the compressor 10 during the cooling operation mode.

The check valve 13*a* is provided in the section of the refrigerant pipes 4 between the heat source side heat exchanger 12 and the relay unit 2 and permits the heat source side refrigerant to flow only in a predetermined direction (i.e. a direction from the outdoor unit 1 to the relay unit 2).

The check valve 13*c* is provided in the section of the refrigerant pipes 4 between the relay unit 2 and the first refrigerant flow switching device 11 and permits the heat source side refrigerant to flow only in a predetermined direction (i.e. a direction from the relay unit 2 to the outdoor unit 1).

The check valve 13*b* is provided on the second connecting pipe 4*b* and, during heating operation, allows the heat source side refrigerant having returned from the relay unit 2 to flow through the suction side of the compressor 10.

The check valve 13*d* is provided on the first connecting pipe 4*a* and, during heating operation, allows the heat source side refrigerant discharged from the compressor 10 to flow through the relay unit 2.

The first connecting pipe 4*a* connects the section of the refrigerant pipes 4 between the first refrigerant flow switching device 11 and the check valve 13*c* to the section of the refrigerant pipes 4 between the check valve 13*a* and the relay unit 2 in the outdoor unit 1. The second connecting pipe 4*b* connects the section of the refrigerant pipes 4 between the check valve 13*c* and the relay unit 2 to the section of the refrigerant pipes 4 between the heat source side heat exchanger 12 and the check valve 13*a* in the outdoor unit 1. It should be noted that although FIG. 2 shows, as an example, a case where the first connecting pipe 4*a*, the second connecting pipe 4*b*, the check valve 13*a*, the check valve 13*b*, the check valve 13*c*, and the check valve 13*d* are provided, this does not imply any limitation and it is not always necessary to provide them.

[Indoor Units 3]

The indoor units 3 include use-side heat exchangers 35*a* to 35*d* (sometimes simply referred to as "use-side heat exchangers 35"). These use-side heat exchangers 35 are connected to heat medium flow control devices 34*a* to 34*d* (sometimes simply referred to as "heat medium flow control devices 34") via the heat medium pipes 5 and to second heat medium flow switching devices 33*a* to 33*d* (sometimes simply referred to as "second heat medium flow switching devices 33") via the heat medium pipes 5. Each of these use-side heat exchangers 35 exchanges heat between air that is supplied from an air-sending device such as a fan (not illustrated) and the heat medium and generates heating air or cooling air to be supplied to the indoor space 7.

FIG. 2 shows an example of a case where the indoor units 3*a* to 3*d* are connected to the relay unit 2 via the heat medium pipes 5. Further, the use-side heat exchangers 35, too, are configured such that the use-side heat exchanger 35*a*, the use-side heat exchanger 35*b*, the use-side heat exchanger 35*c*, and the use-side heat exchanger 35*d* are arranged in this order from the top of the surface of paper in correspondence with the indoor units 3*a* to 3*d*. It should be noted that the number of indoor units 3 that are connected is not limited to 4.

[Relay Unit 2]

The relay unit 2 is mounted with the two intermediate heat exchangers 25*a* and 25*b* (sometimes simply referred to as "intermediate heat exchangers 25"), two expansion devices 26*a* and 26*b* (sometimes simply referred to as "expansion devices 26"), two opening and closing devices 27 and 29, and two second refrigerant flow switching devices 28*a* and 28*b* (sometimes simply referred to as "second refrigerant flow switching devices 28"). The relay unit 2 is further mounted with the two pumps 31*a* and 31*b* (sometimes simply referred to as "pumps 31"), which serve as heat medium conveying devices, four first heat medium flow switching devices 32*a* to 32*d* (sometimes simply referred to as "first heat medium flow switching devices 32"), the four second heat medium flow switching devices 33*a* to 33*d* (sometimes simply referred to as "second heat medium flow switching devices 33"), and the four heat medium flow control devices 34*a* to 34*d* (sometimes simply referred to as "heat medium flow control devices 34").

It should be noted that the first heat medium flow switching devices 32*a* to 32*d*, the second heat medium flow switching devices 33*a* to 33*d*, and the heat medium flow control devices 34*a* to 34*d* may be replaced by an integrated flow switching device that has an integrated combination of the functions of these switching devices. A specific example of the integrated flow switching device may be configured to have a block (integrated) structure such as that disclosed, for example, in International Publication No. 2014/128961 which includes the respective functions of the first heat medium flow switching devices 32*a* to 32*d*, the second heat medium flow switching devices 33*a* to 33*d*, and the heat medium flow control devices 34*a* to 34*d*.

Each of the intermediate heat exchangers 25 functions as a condenser (radiator) or an evaporator to exchange heat between the heat source side refrigerant and the heat medium and transfer, to the heat medium, cooling energy or heating energy generated in the outdoor unit 1 and stored in the heat source side refrigerant. That is, during heating operation, the intermediate heat exchanger 25 functions as a condenser (radiator) to transfer the heating energy of the heat source side refrigerant to the heat medium. Further, during cooling operation, the intermediate heat exchanger 25 functions as an evaporator to transfer the cooling energy of the heat source side refrigerant to the heat medium.

The intermediate heat exchanger 25*a* is provided between the expansion device 26*a* and the second refrigerant flow switching device 28*a* in the refrigerant cycle circuit A and used to cool the heat medium during the cooling and heating mixed operation mode. Further, the intermediate heat exchanger 25*b* is provided between the expansion device 26*b* and the second refrigerant flow switching device 28*b* in the refrigerant cycle circuit A and used to heat the heat medium during the cooling and heating mixed operation mode.

Each of the expansion devices 26 functions as a pressure reducing valve or an expansion valve to expand the heat source side refrigerant under reduced pressure. The expansion device 26*a* is provided on an upstream side of the intermediate heat exchanger 25*a* in the flow of the heat source side refrigerant during cooling operation (see FIG. 5, which will be described later). The expansion device 26*b* is provided on an upstream side of the intermediate heat exchanger 25*b* in the flow of the heat source side refrigerant during cooling operation (see FIG. 5, which will be described later). The expansion devices 26 may be constituted by ones whose opening degrees are variably controllable, such as electronic expansion valves.

The opening and closing device 27 and the opening and closing device 29 are constituted, for example, by solenoid valves whose opening and closing operations are made possible by energization or similar devices, and serve to open and close the flow passages in which they are provided. That is, the opening and closing device 27 and the opening and closing device 29 control opening and closing according to operation mode and switch between flow passages of the heat source side refrigerant.

The opening and closing device 27 is provided on a refrigerant pipe 4 located on a heat source side refrigerant inlet side (i.e. a refrigerant pipe 4 located at the lowermost level of the surface of paper of the refrigerant pipes 4 connecting the outdoor unit 1 to the relay unit 2). The opening and closing device 29 is provided on a pipe (bypass pipe 20) connecting the refrigerant pipe 4 located on the heat source side refrigerant inlet side to a refrigerant pipe 4 located on a heat source side refrigerant outlet side. It should be noted that the opening and closing device 27 and the opening and closing device 29 need only be ones provided with openable and closable flow passages and may be ones whose opening degrees are controlled, such as electronic expansion valves.

Each of the second refrigerant flow switching devices 28 is constituted, for example, by a four-way valve or a similar device and switches the flow of the heat source side refrigerant so that the corresponding intermediate heat exchanger 25 functions as a condenser or an evaporator according to operation mode. In a case where the corresponding intermediate heat exchanger 25 functions as a condenser, the second refrigerant flow switching device 28 switches to a solid line side of FIG. 2 (i.e. switches to the after-mentioned heating operation opening degree direction), and in a case where the corresponding intermediate heat exchanger 25 functions as an evaporator, the second refrigerant flow switching device 28 switches to a dotted line side of FIG. 2 (i.e. switches to the after-mentioned cooling operation opening degree direction). The second refrigerant flow switching device 28*a* is provided on a downstream side of the intermediate heat exchanger 25*a* in the flow of the heat source side refrigerant during cooling operation. The second refrigerant flow switching device 28*b* is provided on a downstream side of the intermediate heat exchanger 25*b* in the flow of the heat source side refrigerant during a cooling only operation mode.

The pumps 31 cause the heat medium flowing through the heat medium pipes 5 to circulate through the heat medium cycle circuit B. The pump 31*a* is provided in the section of the heat medium pipes 5 between the intermediate heat exchanger 25*a* and the second heat medium flow switching devices 33. The pump 31*b* is provided in the section of the heat medium pipes 5 between the intermediate heat exchanger 25*b* and the second heat medium flow switching devices 33. The pumps 31 may be constituted, for example, by capacity-controllable pumps or similar devices whose flow rates can be controlled according to the magnitude of loads on the indoor units 3.

Each of the first heat medium flow switching devices 32 switches between connecting an outlet side of a heat medium flow passage of the corresponding use-side heat exchanger 35 to an inlet side of a heat medium flow passage of the intermediate heat exchanger 25*a* and connecting the outlet side of the heat medium flow passage of the corresponding use-side heat exchanger 35 to an inlet side of a heat medium flow passage of the intermediate heat exchanger 25*b*. The number (which is 4 here) of first heat medium flow switching devices 32 that are provided corresponds to the number of indoor units 3 that are installed. Each of the first heat medium flow switching devices 32 has three sides connected to the intermediate heat exchanger 25*a*, the intermediate heat exchanger 25*b*, and the corresponding heat medium flow control device 34, respectively, and is provided on the outlet side of the heat medium flow passage of the corresponding use-side heat exchanger 35. It should be noted that the first heat medium flow switching device 32*a*, the first heat medium flow switching device 32*b*, the first heat medium flow switching device 32*c*, and the first heat medium flow switching device 32*d* are illustrated in this order from the top of the surface of paper in correspondence with the indoor units 3. Further, the switching of heat medium flow passages includes not only complete switching from one side to the other but also partial switching from one side to the other. These first heat medium flow switching devices 32 may be constituted, for example, by three-way valves or similar devices.

Each of the second heat medium flow switching devices 33 switches between connecting an inlet side of the heat medium flow passage of the corresponding use-side heat exchanger 35 to an outlet side of the heat medium flow passage of the intermediate heat exchanger 25*a* and connecting the inlet side of the heat medium flow passage of the corresponding use-side heat exchanger 35 to an outlet side of the heat medium flow passage of the intermediate heat exchanger 25*b*. The number (which is 4 here) of second heat medium flow switching devices 33 that are provided corresponds to the number of indoor units 3 that are installed. Each of the second heat medium flow switching devices 33 has three sides connected to the intermediate heat exchanger 25*a*, the intermediate heat exchanger 25*b*, and the corresponding use-side heat exchanger 35, respectively, and is provided on the inlet side of the heat medium flow passage of the corresponding use-side heat exchanger 35. It should be noted that the second heat medium flow switching device 33*a*, the second heat medium flow switching device 33*b*, the second heat medium flow switching device 33*c*, and the second heat medium flow switching device 33*d* are illustrated in this order from the top of the surface of paper in correspondence with the indoor units 3. Further, the switching of heat medium flow passages includes not only complete switching from one side to the other but also partial switching from one side to the other. These second heat medium flow switching devices 33 may be constituted, for example, by three-way valves or similar devices.

The first heat medium flow switching devices 32 and the second heat medium flow switching devices 33 constitute heat medium flow switching devices of the present invention.

The heat medium flow control devices 34 are constituted, for example, by two-way valves whose opening areas can be controlled or similar devices and control the flow rate of the heat medium flowing through the heat medium pipes 5. The number (which is 4 here) of heat medium flow control devices 34 that are provided corresponds to the number of indoor units 3 that are installed. Each of the heat medium flow control devices 34 has two sides connected to the corresponding use-side heat exchanger 35 and the corresponding first heat medium flow switching device 32, respectively, and is provided on the outlet side of the heat medium flow passage of the corresponding use-side heat exchanger 35. That is, each of the heat medium flow control devices 34 controls, according to the temperature of the heat medium that flows into the corresponding indoor unit 3 and the temperature of the heat medium that flows out of the corresponding indoor unit 3, the amount of the heat medium that flows into the corresponding indoor unit 3, and makes it possible to provide the corresponding indoor unit 3 with the amount of the heat medium that is most suitable for an indoor load.

It should be noted that the heat medium flow control device 34*a*, the heat medium flow control device 34*b*, the heat medium flow control device 34*c*, and the heat medium flow control device 34*d* are illustrated in this order from the top of the surface of paper in correspondence with the indoor units 3. Alternatively, each of the heat medium flow control devices 34 may be provided on the inlet side of the heat medium flow passage of the corresponding use-side heat exchanger 35. Alternatively, each of the heat medium flow control devices 34 may be provided on the inlet side of the heat medium flow passage of the corresponding use-side heat exchanger 35 and between the corresponding second heat medium flow switching device 33 and the corresponding use-side heat exchanger 35. Furthermore, at the time such as a stop mode or thermo-off when no load is required on an indoor unit 3, the corresponding heat medium flow control device 34 may be fully closed to stop the supply of the heat medium to the indoor unit 3.

It should be noted that the heat medium flow control devices 34 may be omitted by using first heat medium flow switching devices 32 or second heat medium flow switching devices 33 additionally having the functions of the heat medium flow control devices 34.

Alternatively, as mentioned earlier, the first heat medium flow switching devices 32, the second heat medium flow switching devices 33, and the heat medium flow control devices 34 may be substituted with an integrated flow switching device obtained by integrating (making a block of) the first heat medium flow switching devices 32, the second heat medium flow switching devices 33, and the heat medium flow control devices 34 and adding a flow switching function, a flow control function, and a flow passage closing function.

Further, the relay unit 2 is provided with two temperature sensors 40*a* and 40*b* (sometimes simply referred to as "temperature sensors 40"). Each of the temperature sensors 40 detects the temperature of the heat medium having flowed out of the corresponding intermediate heat exchanger 25, i.e. the heat medium at an outlet of the corresponding intermediate heat exchanger 25. The temperature sensor 40*a* is provided on a heat medium pipe 5 located on a heat medium suction side of the pump 31*a*. The temperature sensor 40*b* is provided on a heat medium pipe 5 located on a heat medium suction side of the pump 31*b*. The temperature sensors 40 may be constituted, for example, by thermistors or similar devices.

Information (temperature information) detected by the temperature sensors 40 is sent to a controller 50 that exercises operating control over the air-conditioning apparatus 100. Then, the information (temperature information) detected by the temperature sensors 40 is used to control, for example, the driving frequency of the compressor 10, the rotation speeds of the air-sending devices (not illustrated), the switching of the first refrigerant flow switching device 11, the driving frequencies of the pumps 31, the switching of the second refrigerant flow switching devices 28, the switching of flow passages of the heat medium, the regulation of the heat medium flow rates of the indoor units 3. It should be noted that although the controller 50 is mounted in the relay unit 2 in the example, this does not imply any limitation and the controller 50 may be mounted so as to be able to communicate with the outdoor unit 1, the indoor units 3, or each of the units.

Further, the controller 50 is constituted by a microcomputer or a similar device and controls the driving frequency of the compressor 10, the rotation speeds (including the turning on and turning off) of the air-sending devices, the switching of the first refrigerant flow switching device 11, the driving of the pumps 31, and the opening degrees of the expansion devices 26 in accordance with detection results yielded by various detecting devices and instructions given from a remote controller. In addition to these, the controller 50 controls, for example, the switching of the second refrigerant flow switching devices 28, the switching of the first heat medium flow switching devices 32, the switching of the second heat medium flow switching devices 33, the driving of the heat medium flow control devices 34, the opening and closing of the opening and closing devices 27 and 29, and the opening degree of the after-mentioned heat medium distribution regulating valve 36. That is, the controller 50 is configured to execute each of the after-mentioned operation modes by controlling actuators or similar devices constituting these various types of equipment.

Specifically, the controller 50 performs control so that the indoor space 7 maintains the temperature setting, and when the indoor space 7 reaches the temperature setting, the controller 50 stops the supply of the heat medium to the use-side heat exchangers 35 provided in the indoor units 3 (thermo-off). Further, under instructions from a user, the controller 50 not only stops the supply of the heat medium to the use-side heat exchangers 35 provided in the indoor units 3 but also stops the operation of the fans attached to the use-side heat exchangers 35, even when the indoor space 7 is short of the temperature setting.

The heat medium pipes 5 through which the heat medium flows include one that is connected to the intermediate heat exchanger 25*a* and one that is connected to the intermediate heat exchanger 25*b*. The number (which is 4 here) of branches of each of these heat medium pipes 5 corresponds to the number of connecting ports 60 to which the indoor units 3 are connected. Moreover, the one of the heat medium pipes 5 that is connected to the intermediate heat exchanger 25*a* and the one of the heat medium pipes 5 that is connected to the intermediate heat exchanger 25*b* are connected to each other by the first heat medium flow switching devices 32 and the second heat medium flow switching devices 33. By controlling the first heat medium flow switching devices 32 and the second heat medium flow switching devices 33, it is determined whether to allow the heat medium from the intermediate heat exchanger 25*a* to flow into the use-side heat exchangers 35 or allow the heat medium from the intermediate heat exchanger 25*b* to flow into the use-side heat exchangers 35.

Moreover, in the air-conditioning apparatus 100, the refrigerant cycle circuit A is constituted by the compressor 10, the first refrigerant flow switching device 11, the heat source side heat exchanger 12, the opening and closing device 27, the opening and closing device 29, the second refrigerant flow switching devices 28, refrigerant flow passages of the intermediate heat exchangers 25, the expansion devices 26, and the accumulator 19 through the refrigerant pipes 4. Further, the heat medium cycle circuit B is constituted by the heat medium flow passages of the intermediate heat exchangers 25, the pumps 31, the first heat medium flow switching devices 32, the heat medium flow control devices 34, the use-side heat exchangers 35, and the second heat medium flow switching devices 33 through the heat medium pipes 5. That is, the plurality of use-side heat exchangers 35 are connected to each of the intermediate heat exchangers 25 in parallel with one another, so that the heat medium cycle circuit B includes a plurality of circuits. Since there are four connecting ports 60 here, the heat medium cycle circuit B thus constituted includes four circuits.

Therefore, in the air-conditioning apparatus 100, the outdoor unit 1 and the relay unit 2 are connected to each other via the intermediate heat exchangers 25*a* and 25*b* provided in the relay unit 2, and the relay unit 2 and the indoor units 3 are connected to each other via the intermediate heat exchangers 25*a* and 25*b*. That is, in the air-conditioning apparatus 100, the intermediate heat exchangers 25*a* and 25*b* exchange heat between the heat source side refrigerant circulating through the refrigerant cycle circuit A and the heat medium circulating through the heat medium cycle circuit B. With such a configuration, the air-conditioning apparatus 100 can achieve cooling operation or heating operation that is most suitable for the indoor load.

Further, in the air-conditioning apparatus 100, as mentioned above, the heat medium cycle circuit B includes two distribution parallel circuits 70*a* and 70*b* that cause the heat medium flowing through the heat medium cycle circuit B to diverge into a plurality of (here, two) flows that go to the indoor units 3*a*-1 and 3*a*-2, respectively, in parallel with each other. Moreover, the air-conditioning apparatus 100 according to Embodiment is configured such that connecting the heat medium distribution device 15 to the connecting port 60*a* makes it possible to control the respective heat medium flow rates of the indoor units 3*a*-1 and 3*a*-2. The following describes the heat medium distribution device 15.

[Heat Medium Distribution Device 15]

Figure 3:
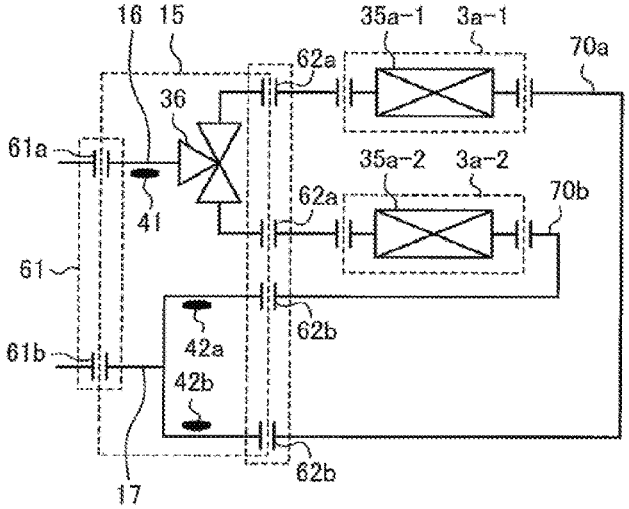
FIG. 3 is a schematic diagram of a configuration of a heat medium distribution device 15 of the air-conditioning apparatus according to Embodiment of the present invention.

FIG. 3 is a schematic diagram of a configuration of the heat medium distribution device 15 of the air-conditioning apparatus according to Embodiment of the present invention.

As shown in FIG. 3, the heat medium distribution device 15 constitutes a part of the heat medium cycle circuit B and includes a first connecting port 61 where the heat medium distribution device 15 is connected to the relay unit 2 and a second connecting port 62 where the heat medium distribution device 15 is connected to the indoor units 3*a*-1 and 3*a*-2. The first connecting port 61 includes an inlet side connecting port 61*a* and an outlet side connecting port 61*b*. Moreover, the relay unit 2 and the heat medium distribution device 15 are connected to each other by the heat medium pipes 5 via this first connecting port 61. Further, the second connecting port 62 includes outlet side connecting ports 62*a* and inlet side connecting ports 62*b*. The second connecting port 62 includes as many outlet side connecting ports 62*a* as and as many inlet side connecting ports 62*b* as the number of indoor units that can be connected to a single circuit of the heat medium cycle circuit B.

Further, the heat medium distribution device 15 includes a distribution pipe 16 and a converging pipe 17. The distribution pipe 16 connects the inlet side connecting port 61*a* to the outlet side connecting ports 62*a*, causes the heat medium from the relay unit 2 that has entered through the inlet side connecting port 61*a* to diverge into flows, and guides the flows to the plurality of outlet side connecting ports 62*a*. The converging pipe 17 connects the plurality of inlet side connecting ports 62*b* to the outlet side connecting port 61*b*, converges the heat medium from each of the indoor units 3*a*-1 and 3*a*-2 that has entered through the plurality of inlet side connecting ports 62*b*, and guides the heat medium to the outlet side connecting port 61*b*.

Moreover, the distribution pipe 16 is provided with a heat medium distribution regulating valve 36. The heat medium distribution regulating valve 36 controls the flow rates of the use-side heat exchangers 35*a*-1 and 35*a*-2 by causing the heat medium of the heat medium cycle circuit B that has flowed from the relay unit 2 into the heat medium distribution device 15 to diverge at a given diverging ratio. The heat medium distribution regulating valve 36 is for example a three-way valve that includes a stepping motor and can change opening areas for each separate designated opening degree. As the designated opening degree becomes larger, the heat medium distribution regulating valve 36 increases the amount of the heat medium that flows into the use-side heat exchanger 35*a*-1 and decreases the amount of the heat medium that flows into the use-side heat exchanger 35*a*-2.

The heat medium distribution device 15 further includes a temperature sensor 41 and temperature sensors 42*a* and 42*b*. The temperature sensor 41 detects the temperature of the heat medium that flows into the heat medium distribution device 15. The temperature sensors 42*a* and 42*b* detect the temperature of the heat medium having exchanged heat in the use-side heat exchangers 35*a*-1 and 35*a*-2. It should be noted that the temperature sensor 41 and the temperature sensors 42*a* and 42*b* constitute a temperature detecting device of the present invention.

These temperature sensors are constituted, for example, by thermistors or similar devices. On the basis of temperatures detected by these temperature sensors, the heat medium distribution regulating valve 36 is controlled so that the heat medium is conveyed at optimum flow rates to the use-side heat exchangers 35*a*-1 and 35*a*-2. The heat medium distribution regulating valve 36 is controlled by the controller 50 according to the respective loads of the indoor units 3*a*-1 and 3*a*-2. Details of control of the heat medium distribution regulating valve 36 will be fully discussed later.

[Operation Modes]

Each operation mode that the air-conditioning apparatus 100 executes is described. This air-conditioning apparatus 100 is capable of heating operation or cooling operation in each of the indoor units 3 according to instructions from that indoor unit 3. That is, the air-conditioning apparatus 100 can both make all of the indoor units 3 operate in the same manner and make each of the indoor units 3 operate in a different manner.

The air-conditioning apparatus 100 executes the following four operation modes. The following describes each of the operation modes, together with the flow of the heat source side refrigerant and the heat medium.

(a) Cooling only operation mode in which all operating indoor units 3 execute cooling operation (b) Heating only operation mode in which all operating indoor units 3 execute heating operation (c) Cooling main operation mode with a higher cooling load, of a cooling and heating mixed operation mode in which there is a mixture of indoor units 3 that execute cooling operation and indoor units 3 that execute heating operation (d) Heating main operation mode with a higher heating load, of the cooling and heating mixed operation mode in which there is a mixture of indoor units 3 that execute cooling operation and indoor units 3 that execute heating operation The following describes each of these modes. It should be noted that, as mentioned above, the indoor unit 3*a* includes the two separate indoor units 3*a*-1 and 3*a*-2; however, from the point of view of providing a brief overview of the basic operation of each mode, the following description of each mode assumes, for convenience, that the indoor unit 3*a* does not include two indoor units but is a single indoor unit. Moreover, the divergence of the heat medium into the indoor units 3*a*-1 and 3*a*-2 will be fully discussed later.

[Heating Operation Mode (Heating Only Mode)]

Figure 4:
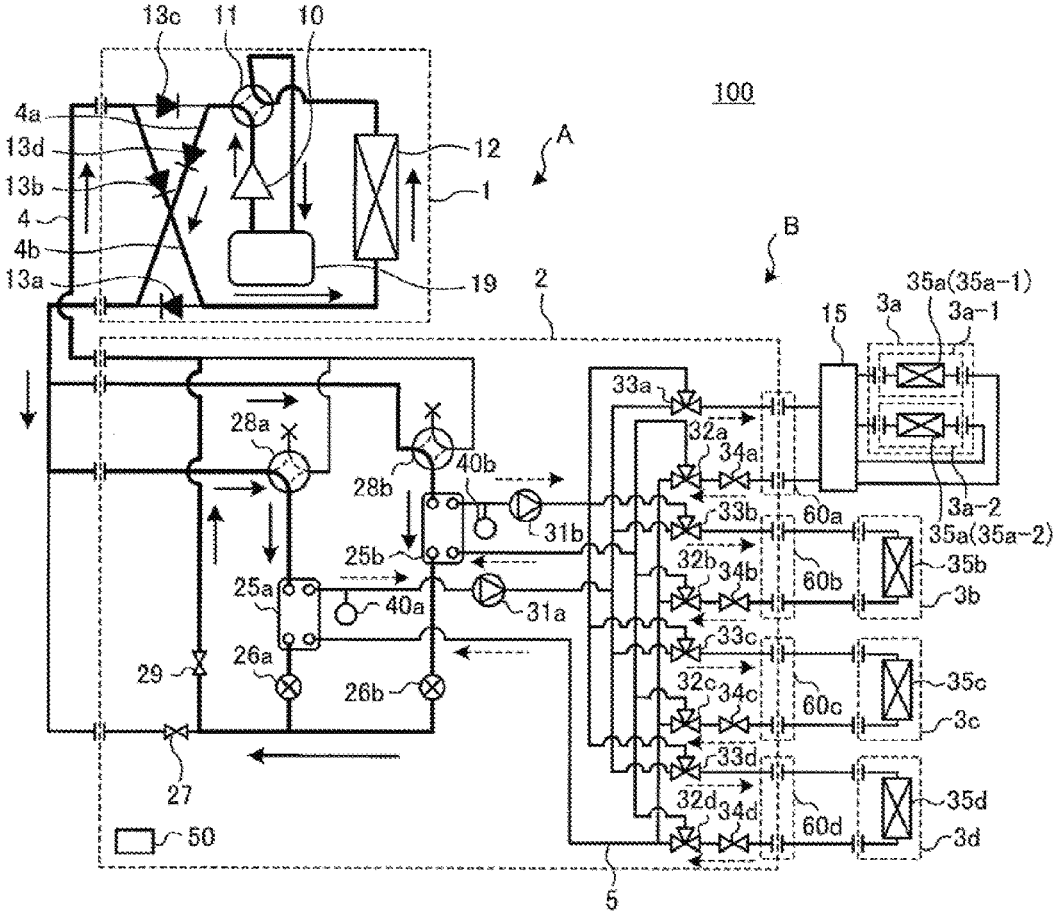
FIG. 4 is a refrigerant circuit diagram showing the flow of refrigerant during a heating operation mode of the air-conditioning apparatus 100 shown in FIG. 2.

FIG. 4 is a refrigerant circuit diagram showing the flow of refrigerant during the heating operation mode of the air-conditioning apparatus 100 shown in FIG. 2. FIG. 4 describes, as an example, a state where the four indoor units 3*a* to 3*d* are in the heating operation mode.

It should be noted that, in FIG. 4, the heavy lines indicate pipes through which the heat source side refrigerant flows. Further, in FIG. 4, the solid arrows indicate flow directions of the heat source side refrigerant and the dotted arrows indicate flow directions of the heat medium.

In the case of the heating operation mode (heating only mode), the outdoor unit 1 switches the first refrigerant flow switching device 11 so that the heat source side refrigerant discharged from the compressor 10 flows into the relay unit 2 without passing through the heat source side heat exchanger 12.

In the relay unit 2, the four first heat medium flow switching devices 32*a* to 32*d* and the four second heat medium flow switching devices 33*a* to 33*d* are switched to a heating side opening degree direction or an intermediate opening degree, as the four indoor units 3 are in the heating operation mode. The phrase "switched to a heating side opening degree direction" refers to being switched to that one of the intermediate heat exchangers 25*a* and 25*b* which functions as a condenser. Note here that, in the heating only operation mode, in which both the intermediate heat exchangers 25*a* and 25*b* function as condensers, the phrase refers to being switched to either of the intermediate heat exchangers 25*a* and 25*b*. Further, the term "intermediate opening degree" refers to an opening degree made intermediate so that flow passages to both the intermediate heat exchangers 25*a* and 25*b* are secured.

Further, the opening and closing device 27 is closed, and the opening and closing device 29 is open. Further, the four heat medium flow control devices 34*a* to 34*d* are at heat medium flow control opening degrees. That is, the four heat medium flow control devices 34*a* to 34*d* are controlled to give flow rates needed to cover air conditioning loads needed in rooms in which the indoor units 3*a* to 3*d* are installed, respectively.

It should be noted that the pumps 31 operate in accordance with values indicating flow rates appropriate to indoor unit loads. Further, the second refrigerant flow switching devices 28 are in a state of having been switched to a heating operation opening degree direction.

First of all, the flow of the heat source side refrigerant through the refrigerant cycle circuit A is described.

A low-temperature and low-pressure refrigerant is compressed by the compressor 10 into a high-temperature and high-pressure gas refrigerant that is then discharged. The high-temperature and high-pressure gas refrigerant discharged from the compressor 10 flows out of the outdoor unit 1 via the first refrigerant flow switching device 11 and the first connecting pipe 4*a*. The high-temperature and high-pressure gas refrigerant having flowed out of the outdoor unit 1 flows into the relay unit 2 through the refrigerant pipes 4. The high-temperature and high-pressure gas refrigerant having flowed into the relay unit 2 passes through the second refrigerant flow switching devices 28*a* and 28*b*, passes through the intermediate heat exchangers 25*a* and 25*b*, passes through the expansion devices 26*a* and 26*b*, and then passes through the opening and closing device 29. The refrigerant having passed through the opening and closing device 29 is conveyed to the outdoor unit 1 and exchanges heat with outside air in the heat source side heat exchanger 12 to become a low-temperature and low-pressure gas refrigerant. The low-temperature and low-pressure gas refrigerant is sucked again into the compressor 10 via the first refrigerant flow switching device 11 and the accumulator 19.

At this point in time, the expansion devices 26*a* and 26*b* have their opening degrees controlled so that the degrees of subcooling of the refrigerant at the outlets of the intermediate heat exchangers 25*a* and 25*b* become constant. These degrees of subcooling are obtained as the differences between values obtained by converting, into saturation temperatures, the pressures of the heat source side refrigerant flowing between the intermediate heat exchangers 25*a* and 25*b* and the expansion devices 26*a* and 26*b* and temperatures at the outlet sides of the intermediate heat exchangers 25*a* and 25*b*, respectively.

Next, the flow of the heat medium through the heat medium cycle circuit B is described.

In the heating only operation mode, the heating energy of the heat source side refrigerant is transferred to the heat medium in both the intermediate heat exchanger 25*a* and the intermediate heat exchanger 25*b* so that the heat medium thus heated is caused by the pump 31*a* and the pump 31*b* to flow through the heat medium pipes 5. The heat medium pressurized by the driving of the pump 31*a* and the pump 31*b* is sent into the use-side heat exchangers 35*a* to 35*d*, exchanges heat with indoor air, flows out of the use-side heat exchangers 35*a* to 35*d*, and then flows into the heat medium flow control devices 34*a* to 34*d*. At this point in time, the heat medium is controlled by the functions of the heat medium flow control devices 34*a* to 34*d* to pass through the use-side heat exchangers 35*a* to 35*d* and the heat medium flow control devices 34*a* to 34*d* at the flow rates needed to cover the air conditioning loads needed in the rooms.

The heat medium having flowed out of the heat medium flow control devices 34*a* to 34*d* passes through the heat medium pipes 5 with its flow passages switched by the first heat medium flow switching devices 32*a* to 32*d*, flows into and passes through the intermediate heat exchanger 25*a* and the intermediate heat exchanger 25*b*, and is sucked again into the pump 31*a* and the pump 31*b*.

[Cooling Operation Mode (Cooling Only Mode)]

Figure 5:
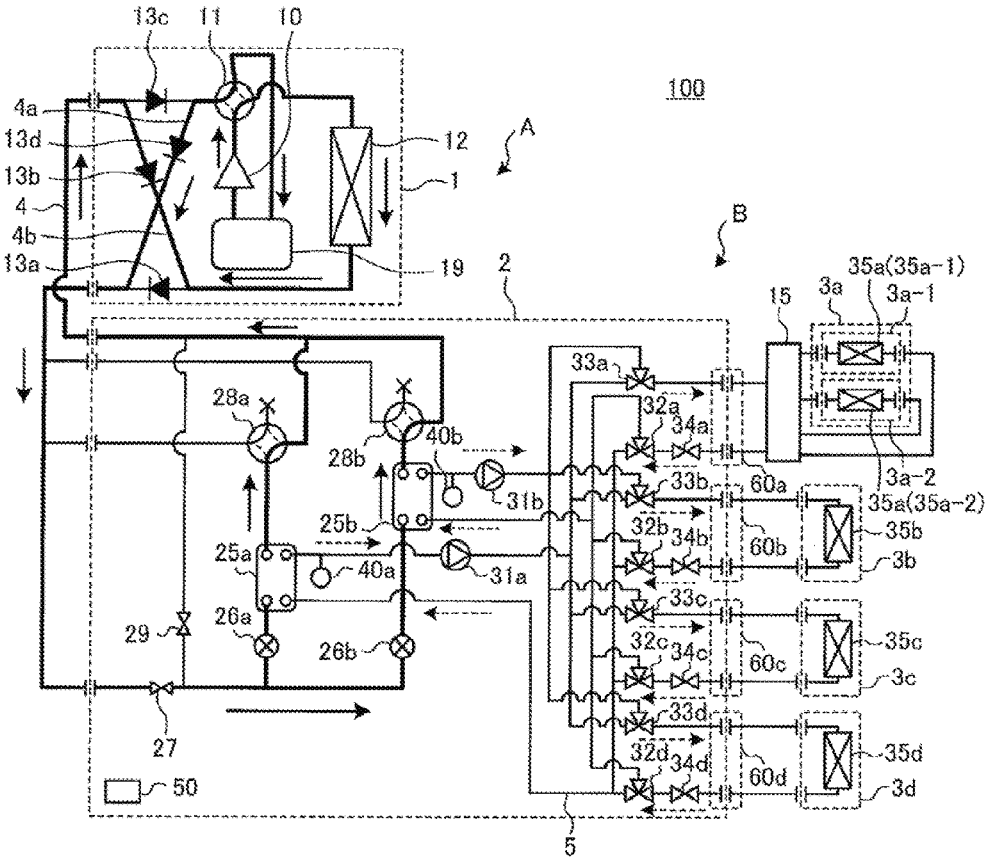
FIG. 5 is a refrigerant circuit diagram showing the flow of refrigerant during a cooling only mode of the air-conditioning apparatus 100 shown in FIG. 2.

FIG. 5 is a refrigerant circuit diagram showing the flow of refrigerant during the cooling only operation mode of the air-conditioning apparatus 100 shown in FIG. 2. FIG. 5 describes, as an example, a state where the four indoor units 3*a* to 3*d* are in the cooling operation mode.

It should be noted that, in FIG. 5, the heavy lines indicate pipes through which the heat source side refrigerant flows. Further, in FIG. 5, the solid arrows indicate flow directions of the heat source side refrigerant and the dotted arrows indicate flow directions of the heat medium.

In the case of the cooling operation mode (cooling only mode), the outdoor unit 1 switches the first refrigerant flow switching device 11 so that the heat source side refrigerant discharged from the compressor 10 flows into the heat source side heat exchanger 12.

In the relay unit 2, the four first heat medium flow switching devices 32*a* to 32*d* and the four second heat medium flow switching devices 33*a* to 33*d* are switched to a cooling side opening degree direction or an intermediate opening degree, as the four indoor units 3 are in the cooling operation mode. Further, the opening and closing device 27 is open, and the opening and closing device 29 is closed. Further, the expansion device 26*a* and the expansion device 26*b* are at heat medium refrigerant flow control opening degrees.

It should be noted that the pumps 31 operate in accordance with values indicating flow rates appropriate to indoor unit loads. The second refrigerant flow switching devices 28 are in a state of having been switched to a cooling operation opening degree direction.

First of all, the flow of the heat source side refrigerant through the refrigerant cycle circuit A is described.

A low-temperature and low-pressure refrigerant is compressed by the compressor 10 into a high-temperature and high-pressure gas refrigerant that is then discharged. The high-temperature and high-pressure gas refrigerant discharged from the compressor 10 flows into the heat source side heat exchanger 12 via the first refrigerant flow switching device 11. The refrigerant having flowed into the heat source side heat exchanger 12 exchanges heat with outside air to become a high-temperature and high-pressure liquid or two-phase refrigerant that then flows out of the heat source side heat exchanger 12. The refrigerant having flowed out of the heat source side heat exchanger 12 passes through the check valve 13*a* and then flows out of the outdoor unit 1. The liquid or two-phase refrigerant having flowed out of the outdoor unit 1 flows into the relay unit 2 through the refrigerant pipes 4.

The high-temperature and high-pressure liquid or two-phase refrigerant having flowed into the relay unit 2 passes through the opening and closing device 27 and then is expanded by the expansion devices 26*a* and 26*b* to become a low-temperature and low-pressure two-phase refrigerant. This two-phase refrigerant exchanges heat with the heat medium in the intermediate heat exchangers 25*a* and 25*b* to become a low-temperature and low-pressure gas refrigerant. The gas refrigerant having flowed out of the intermediate heat exchanger 25*a* and the intermediate heat exchanger 25*b* passes through the second refrigerant flow switching device 28*a* and the second refrigerant flow switching device 28*b* and then converges to flow out of the relay unit 2. The refrigerant having flowed out of the relay unit 2 passes through the refrigerant pipes 4 and the check valve 13*c* and is sucked again into the compressor 10 via the first refrigerant flow switching device 11 and the accumulator 19.

At this point in time, the expansion devices 26 have their opening degrees controlled so that degrees of superheat become constant. The degrees of superheat are obtained as the differences between values obtained by converting, into saturation temperatures, the pressures of the heat source side refrigerant flowing between the intermediate heat exchangers 25 and the expansion devices 26 and temperatures at the outlet sides of the intermediate heat exchangers 25, respectively. It should be noted that in a case where the temperatures of the intermediate heat exchangers 25 in intermediate positions can be measured, it is possible to substitute saturation temperatures obtained by converting the temperatures in those intermediate positions. This eliminates the need to install pressure sensors and makes it possible to configure a system at low cost.

Next, the flow of the heat medium through the heat medium cycle circuit B is described.

In the cooling only operation mode, the cooling energy of the heat source side refrigerant is transferred to the heat medium in both the intermediate heat exchanger 25*a* and the intermediate heat exchanger 25*b* so that the heat medium thus cooled is caused by the pump 31*a* and the pump 31*b* to flow through the heat medium pipes 5. The flow of the heat medium through the heat medium cycle circuit B in the cooling only operation mode is the same as the flow of the heat medium during heating only described in FIG. 4. The heat medium pressurized by the driving of the pump 31*a* and the pump 31*b* is sent into the use-side heat exchangers 35*a* to 35*d*, exchanges heat with indoor air, flows out of the use-side heat exchangers 35*a* to 35*d*, and then flows into the heat medium flow control devices 34*a* to 34*d*. At this point in time, the heat medium is controlled by the functions of the heat medium flow control devices 34*a* to 34*d* to pass through the use-side heat exchangers 35*a* to 35*d* and the heat medium flow control devices 34*a* to 34*d* at the flow rates needed to cover the air conditioning loads needed in the rooms.

The heat medium having flowed out of the heat medium flow control devices 34*a* to 34*d* passes through the heat medium pipes 5 with its flow passages switched by the first heat medium flow switching devices 32*a* to 32*d*, flows into and passes through the intermediate heat exchanger 25*a* and the intermediate heat exchanger 25*b*, and is sucked again into the pump 31*a* and the pump 31*b*.

[Mixed Operation Mode (Heating Main Mode)]

Figure 6:
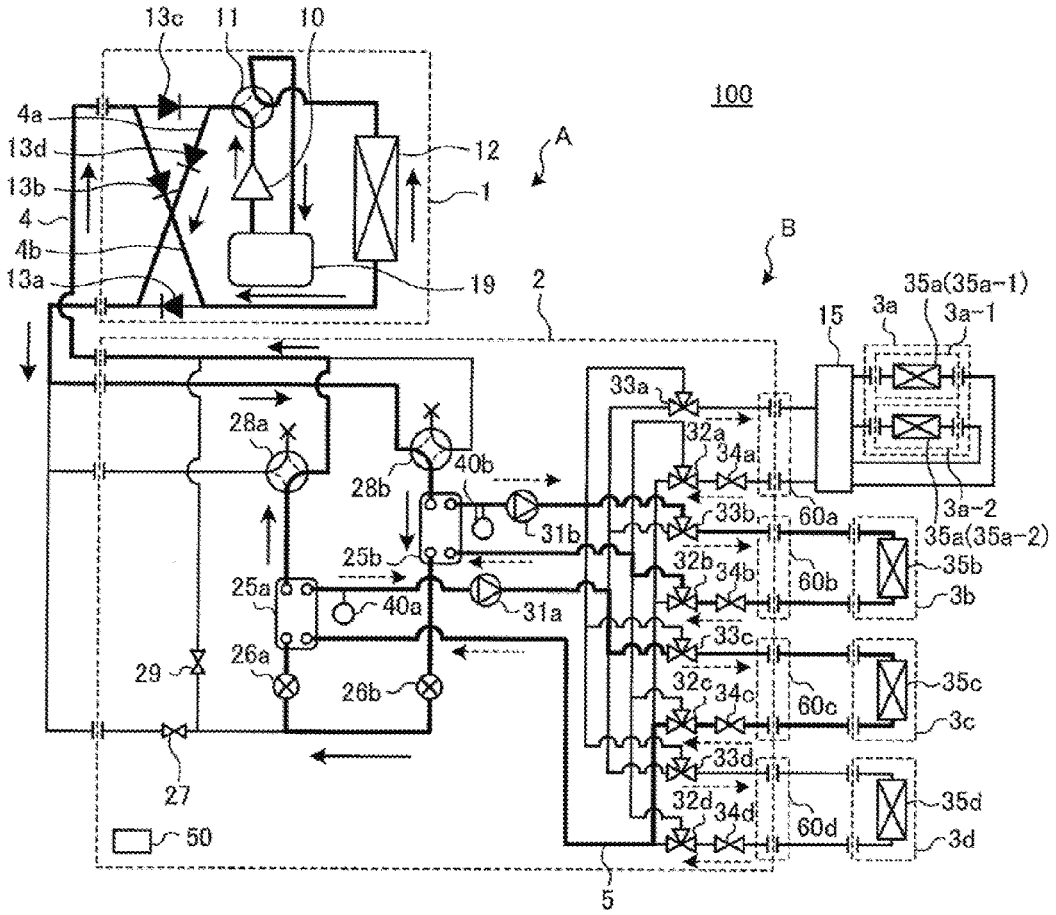
FIG. 6 is a refrigerant circuit diagram showing the flow of refrigerant during heating main operation of a mixed operation mode of the air-conditioning apparatus 100 shown in FIG. 2.

FIG. 6 is a refrigerant circuit diagram showing the flow of refrigerant during heating main operation of the mixed operation mode of the air-conditioning apparatus 100 shown in FIG. 2. Note here that the mixed operation mode is described by taking, as an example, an operational state in which the indoor unit 3*a* of the four indoor units 3*a* to 3*d* is in the heating operation mode, the indoor unit 3*d* of the four indoor units 3*a* to 3*d* is in the cooling operation mode, and the proportion of heating operation is greater than the proportion of cooling operation. Moreover, the other indoor units 3*b* and 3*c* are free of loads because of shutdown (do not need to cool or heat the interior of the rooms, including a thermo-off state) so that the heat medium does not flow through the use-side heat exchangers 35*b* and 35*c*.

It should be noted that, in FIG. 6, the heavy lines indicate pipes through which the heat source side refrigerant flows. Further, in FIG. 6, the solid arrows indicate flow directions of the heat source side refrigerant and the dotted arrows indicate flow directions of the heat medium.

In the case of the mixed operation mode (heating main operation mode), the outdoor unit 1 switches the first refrigerant flow switching device 11 so that the heat source side refrigerant discharged from the compressor 10 flows into the relay unit 2 without passing through the heat source side heat exchanger 12.

In the relay unit 2, of the four first heat medium flow switching devices 32*a* to 32*d* and the four second heat medium flow switching devices 33*a* to 33*d*, the first heat medium flow switching device 32*a* and the second heat medium flow switching device 33*a* that are connected to the indoor unit 3*a* which is in the heating operation mode, are switched to the heating side opening degree direction, as the indoor unit 3*a* of the four indoor units 3 is in the heating operation mode and the indoor unit 3*d* of the four indoor units 3 is in the cooling operation mode. That is, the second heat medium flow switching device 33*a* is switched to the intermediate heat exchanger 25*b* of the intermediate heat exchangers 25*a* and 25*b* that is functioning as a condenser. Further, the second heat medium flow switching device 33*d* connected to the indoor unit 3*d*, which is in the cooling operation mode, is switched to the cooling side opening degree direction. That is, the second heat medium flow switching device 33*d* is switched to the intermediate heat exchanger 25*a* of the intermediate heat exchangers 25*a* and 25*b* that is functioning as an evaporator.

Further, the four heat medium flow control devices 34*a* to 34*d* are at heat medium flow control opening degrees. Further, the opening and closing device 27 is closed, and the opening and closing device 29 is open. The expansion device 26*a* and the expansion device 26*b* are at heat medium refrigerant flow control opening degrees.

It should be noted that the pumps 31 operate in accordance with values indicating flow rates appropriate to indoor unit loads. The second refrigerant flow switching device 28*a* is in a state of having been switched to the cooling operation opening degree direction, and the second refrigerant flow switching device 28*b* is in a state of having been switched to the heating operation opening degree direction.

First of all, the flow of the heat source side refrigerant through the refrigerant cycle circuit A is described.

A low-temperature and low-pressure refrigerant is compressed by the compressor 10 into a high-temperature and high-pressure gas refrigerant that is then discharged. The high-temperature and high-pressure gas refrigerant discharged from the compressor 10 flows out of the outdoor unit 1 via the first refrigerant flow switching device 11 and the first connecting pipe 4*a*. The high-temperature and high-pressure gas refrigerant having flowed out of the outdoor unit 1 flows into the relay unit 2 through the refrigerant pipes 4. The high-temperature and high-pressure gas refrigerant having flowed into the relay unit 2 passes through the second refrigerant flow switching device 28*b* and then passes through the intermediate heat exchanger 25*b* functioning as a condenser. The refrigerant having passed through the intermediate heat exchanger 25*b* is depressurized by passing through the expansion device 26*b* and the expansion device 26*a* and flows into the intermediate heat exchanger 25*a* functioning as an evaporator.

After that, the refrigerant having flowed out of the intermediate heat exchanger 25*a* passes through the second refrigerant flow switching device 28*a* and then flows out of the relay unit 2. The refrigerant having flowed out of the relay unit 2 is conveyed to the outdoor unit 1 through the refrigerant pipes 4 and exchanges heat with outside air in the heat source side heat exchanger 12 to become a low-temperature and low-pressure gas refrigerant. The low-temperature and low-pressure gas refrigerant is sucked again into the compressor 10 via the first refrigerant flow switching device 11 and the accumulator 19.

At this point in time, the expansion device 26*b* has its opening degree controlled so that a degree of subcooling becomes constant. The degree of subcooling is obtained as the difference between a value obtained by converting, into a saturation temperature, the pressure of the heat source side refrigerant flowing between the intermediate heat exchanger 25*b* and the expansion device 26*b* and a temperature at the outlet side of the intermediate heat exchanger 25*b*.

Further, the expansion device 26*a* has its opening degree controlled so that a degree of superheat becomes constant. The degree of superheat is obtained as the difference between a value obtained by converting, into a saturation temperature, the pressure of the heat source side refrigerant flowing between the intermediate heat exchanger 25*a* and the expansion device 26*a* and a temperature at the outlet side of the intermediate heat exchanger 25*a*.

Next, the flow of the heat medium through the heat medium cycle circuit B is described.

In the heating main operation mode, the heating energy of the heat source side refrigerant is transferred to the heat medium in the intermediate heat exchanger 25*b* so that the heat medium thus heated is caused by the pump 31*b* to flow through the heat medium pipes 5. Further, in the heating main operation mode, the cooling energy of the heat source side refrigerant is transferred to the heat medium in the intermediate heat exchanger 25*a* so that the heat medium thus cooled is caused by the pump 31*a* to flow through the heat medium pipes 5.

The heat medium pressurized by the driving of the pump 31*b* is sent into the use-side heat exchanger 35*a*, heats the interior of the room by exchanging heat with indoor air, and then flows out of the use-side heat exchanger 35*a*. The heat medium having flowed out of the use-side heat exchanger 35*a* passes through the heat medium flow control device 34*a* and the first heat medium flow switching device 32*a* and then flows into and passes through the intermediate heat exchanger 25*b*. Then, the heat medium having passed through the intermediate heat exchanger 25*b* is sucked again into the pump 31*b* and then sent into the use-side heat exchanger 35*a* through the second heat medium flow switching device 33*a*.

Meanwhile, the heat medium pressurized by the driving of the pump 31*a* is sent into the use-side heat exchanger 35*d*, cools the interior of the room by exchanging heat with indoor air, and then flows out of the use-side heat exchanger 35*d*. The heat medium having passed through the heat medium flow control device 34*e* passes through the heat medium flow control device 34*d* and the first heat medium flow switching device 32*d* and then flows into and passes through the intermediate heat exchanger 25*a*. Then, the heat medium having passed through the intermediate heat exchanger 25*a* is sucked again into the pump 31*a* and then sent into the use-side heat exchanger 35*d* through the second heat medium flow switching device 33*d*.

Now that the basic operation of the air-conditioning apparatus 100 has been clarified, control of the heat medium distribution device 15 is described.

[Heat Medium Distribution Device 15]

The following describes a method for controlling the heat medium distribution regulating valve 36 of the heat medium distribution device 15. A description is given here by taking, as an example, a case where the intermediate heat exchanger 25*b* functions as a condenser and the indoor unit 3*a* operates in the heating operation mode. It should be noted that the flow rate of the heat medium that flows into each of the four circuits of the heat medium cycle circuit B is controlled by the corresponding one of the heat medium flow control devices 34*a* to 34*d* according to the heat load of the corresponding one of the indoor units 3*a* to 3*d*, and the heat medium distribution device 15 further causes a heat medium of a flow rate allocated to the indoor unit 3*a* to diverge according to the heat loads of the indoor units 3*a*-1 and 3*a*-2 and flow into the use-side heat exchangers 35*a*-1 and 35*a*-2.

In the relay unit 2, the heat medium whose heat has been removed in the intermediate heat exchanger 25*a* is conveyed from the pump 31*b* to flow into the heat medium distribution device 15. The temperature of the heat medium having flowed into the heat medium distribution device 15 is detected by the temperature sensor 41. The heat medium having flowed into the heat medium distribution device 15 flows into the heat medium distribution regulating valve 36 and diverges through optimum opening degree regulation into flows according to air conditioning loads serving as the respective heat loads of the indoor units 3*a*-1 and 3*a*-2. The flows into which the heat medium has diverged flow into the use-side heat exchangers 35*a*-1 and 35*a*-2, respectively, which are connected on an downstream outlet side of the heat medium distribution device 15, and reject heat into the air in the indoor space 7.

The flows of the heat medium having rejected heat into the air in the indoor space 7 flow again into the heat medium distribution device 15 and converge to be conveyed again to the relay unit 2.

The heat medium distribution regulating valve 36 is controlled in the following manner in order to cover an air conditioning load needed in the indoor space 7. That is, the heat medium distribution regulating valve 36 is controlled so that a temperature difference between temperatures of the heat medium at the inlet and outlet of each of the use-side heat exchangers 35*a*-1 and 35*a*-2 is kept at a target temperature difference ΔTm. The target temperature difference ΔTm is a target value that is determined from the amounts of heat exchange and the flow rates of the heat medium in the use-side heat exchangers 35*a*-1 and 35*a*-2. The following specifically describes controlled variables of the heat medium distribution regulating valve 36 with reference to mathematical formulae.

Assuming that ΔFj is the amount of change in opening degree determined according to the respective air conditioning loads of the use-side heat exchangers 35*a*-1 and 35*a*-2 and Fr is the previously designated opening degree of the heat medium distribution regulating valve 36, the opening degree Fj for which the heat medium distribution regulating valve 36 is designated can be computed according to (Formula 1):

[Math. 1]

$$Fj=+\Delta Fj \quad \text{(Formula 1)}$$

The opening degree Fj can also be said to be an opening degree needed according to the respective loads of the use-side heat exchangers 35*a*-1 and 35*a*-2, i.e. a required opening degree.

Further, the amount of change in opening degree ΔFj is calculated from (Formula 2):

[Math. 2]

$$\Delta Fj=(\Delta Fj1+\Delta Fj2)/2 \quad \text{(Formula 2)}$$

where ΔFj1 is the amount of change in opening degree of the heat medium distribution regulating valve 36 needed according to the load of the use-side heat exchanger 35*a*-1 and ΔFj2 is the amount of change in opening degree of the heat medium distribution regulating valve 36 needed according to the load of the use-side heat exchanger 35*a*-2.

As is clear from (Formula 2) above, the amount of change in opening degree ΔFj is the average of the amount of change in opening degree ΔFj1 and the amount of change in opening degree ΔFj2 needed by the use-side heat exchangers 35*a*-1 and 35*a*-2, respectively. The formula for computation of the amount of change in opening degree ΔFj is not limited to (Formula 2), provided the average amount of change in opening degree can be calculated.

The amounts of change in opening degree ΔFj1 and ΔFj2 of the heat medium distribution regulating valve 36 needed according to the respective loads of the use-side heat exchangers 35*a*-1 and 35*a*-2 can be computed according to the following formulae with use of the temperatures of the heat medium at the inlets and outlets of the use-side heat exchangers 35*a*-1 and 35*a*-2, the target temperature difference ΔTm, and the control gain Gs in the heat medium distribution regulating valve 36.

(Use-Side Heat Exchanger 35*a*-1)

[Math. 3]

$$\text{When } \Delta Tm \geq \Delta T1, \Delta Fj1=Gs\times(\Delta Tm-\Delta T1) \quad \text{(Formula 3)}$$

[Math. 4]

$$\text{When } \Delta Tm < \Delta T1, \Delta Fj1=Gs\times(\Delta T1-\Delta Tm) \quad \text{(Formula 4)}$$

(Use-Side Heat Exchanger 35*a*-2)

[Math. 5]

$$\text{When } \Delta Tm < \Delta T2, \Delta Fj2=Gs\times(\Delta T2-\Delta T2) \quad \text{(Formula 5)}$$

[Math. 6]

$$\text{When } \Delta Tm < \Delta T2, \Delta Fj2=Gs\times(\Delta T2-\Delta Tm) \quad \text{(Formula 6)}$$

At this time,

[Math. 7]

$$\Delta T1=|(\text{Temperature Sensor 42}a\text{ Value})-(\text{Temperature Sensor 41 Value})| \quad \text{(Formula 7)}$$

[Math. 8]

$$\Delta T2=|(\text{Temperature Sensor 42}b\text{ Value})-(\text{Temperature Sensor 41 Value}| \quad \text{(Formula 8)}$$

It should be noted that the control gain Gs is determined by the opening degree speed of the heat medium distribution regulating valve 36 the responsiveness of the use-side heat exchangers 35*a*-1 and 35*a*-2 to the heat loads. Further, as is clear from (Formula 7), ΔT1 is the temperature difference between the temperatures of the heat medium before and after heat exchange in the use-side heat exchanger 35*a*-1. As is clear from (Formula 8), ΔT2 is the temperature difference between the temperatures of the heat medium before and after heat exchange in the use-side heat exchanger 35*a*-2.

The amounts of change in opening degree ΔFj1 and ΔFj2 take on larger values as the differences between the current temperature differences between the temperatures of the heat medium before and after heat exchange in the use-side heat exchangers 35*a*-1 and 35*a*-2, respectively, and the target temperature difference ΔTm become larger. Conversely, the amounts of change in opening degree ΔFj1 and ΔFj2 take on smaller values as the temperature differences between the current differences between the temperatures of the heat medium before and after heat exchange in the use-side heat exchangers 35*a*-1 and 35*a*-2, respectively, and the target temperature difference ΔTm become smaller.

The use of (Formula 1) to (Formula 8) above makes it possible to designate the opening degree Fj of the heat medium distribution regulating valve 36, thus making it possible to feed the heat medium to the use-side heat exchangers 35*a*-1 and 35*a*-2 at optimum flow rates.

An explanation is given with reference to a specific example. Assume, for example, a case where a transition occurs from a state where ΔFj is 0 with the heat medium diverging into the use-side heat exchangers 35*a*-1 and 35*a*-2 in equal proportions to a state where both the use-side heat exchangers 35*a*-1 and 35*a*-2 have increased loads and the use-side heat exchanger 35*a*-2 is greater in degree of increase in load than the use-side heat exchanger 35*a*-1. In this case, ΔT2 takes on a larger value than ΔT1; for example, if ΔFj1 is calculated to be 2 and ΔFj2 is calculated to be 4, ΔFj takes on 3. In this case, where ΔFj increases from 0 to 3, the designated opening degree Fj increases. This increase the flow rate of the heat medium that flows into the use-side heat exchanger 35*a*-1 and decreases the flow rate of the heat medium that flows into the use-side heat exchanger 35*a*-2.

A change in the designated opening degree Fj leads to a change in return water temperature that is detected by the temperature sensor 41. In this case example, since both the use-side heat exchangers 35*a*-1 and 35*a*-2 have increased loads, the required flow rate increases, so that the heat medium flow control device 34*a* has its opening degree controlled in such a direction as to open. This increases the flow rate of the heat medium that flows into the heat medium distribution device 15.

The calculation of the designated opening degree Fj of the heat medium distribution regulating valve 36 and the designation of the opening degree Fj for the heat medium distribution regulating valve 36 are performed at every interval of control, and ΔFj, which is obtained by averaging ΔFj1 and ΔFj2 as mentioned above, is used in calculating the opening degree Fj. Moreover, the designation of the designated opening degree Fj calculated using ΔFj obtained by such averaging is repeated, with the result that the flow rates needed for both the use-side heat exchangers 35*a*-1 and 35*a*-2 can be secured. It should be noted that the numerical values of ΔFj1 and ΔFj2 above are ones used to clarify the explanation here and these numerical values do not imply any limitation.

Figure 7:
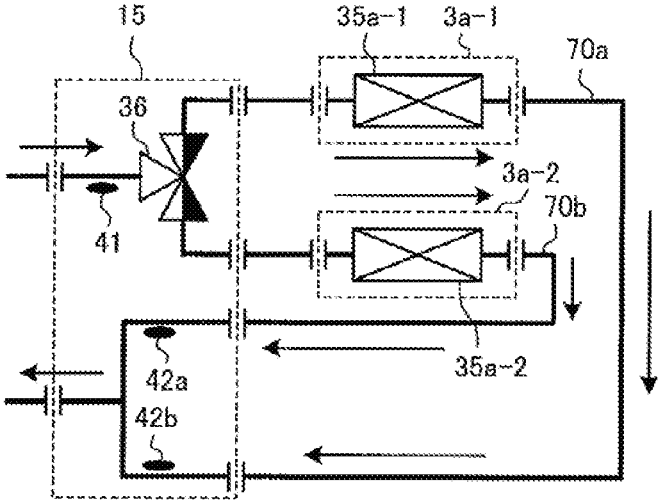
FIG. 7 is a diagram (Part 1) showing an opening degree image of a heat medium distribution regulating valve 36 of the heat medium distribution device 15 of the air-conditioning apparatus according to Embodiment of the present invention.

FIG. 7 is a diagram showing an opening degree image of the heat medium distribution regulating valve 36 of the heat medium distribution device 15 of the air-conditioning apparatus according to Embodiment of the present invention. In FIG. 7, the filled portions of the heat medium distribution regulating valve 36 mean closures inside the opening ports. In the case of FIG. 7, the opening degree image represents a case where the loads on the use-side heat exchangers 35*a*-1 and 35*a*-2 are uniform. Furthermore, in FIG. 7, the opening degree image means that the use-side heat exchangers 35*a*-1 and 35*a*-2 have their respective opening areas halved with uniform loads thereon. This control can be achieved by applying (Formula 1) to (Formula 8) to the heat medium distribution regulating valve 36.

Figure 8:
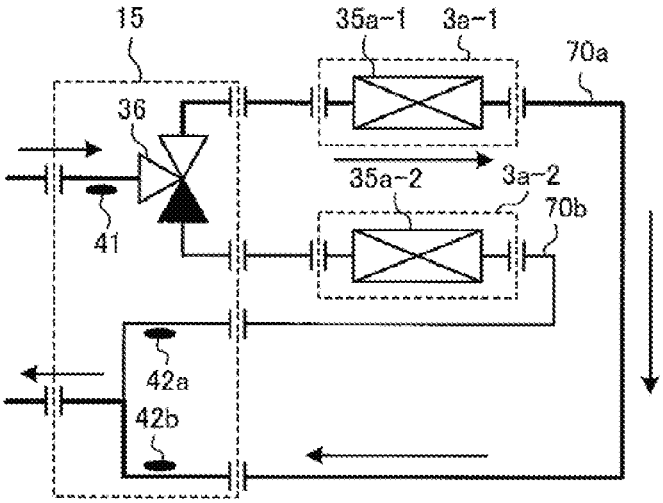
FIG. 8 is a diagram (Part 2) showing an opening degree image of the heat medium distribution regulating valve 36 of the heat medium distribution device 15 of the air-conditioning apparatus according to Embodiment of the present invention.

FIG. 8 is a diagram showing an opening degree image of the heat medium distribution regulating valve 36 of the heat medium distribution device 15 of the air-conditioning apparatus according to Embodiment of the present invention. In FIG. 8, the filled portion of the heat medium distribution regulating valve 36 means a closure inside the opening port. In the case of FIG. 8, the opening degree image represents a case where all of the heat medium having flowed into the heat medium distribution device 15 flows into the use-side heat exchanger 35*a*-1 and the heat medium does not flow into the use-side heat exchanger 35*a*-2. That is, the opening degree image means there is a load on the use-side heat exchanger 35*a*-1 and there is no load on the use-side heat exchanger 35*a*-2. This control can be achieved by applying (Formula 1) to (Formula 8) to the heat medium distribution regulating valve 36.

Figure 9:
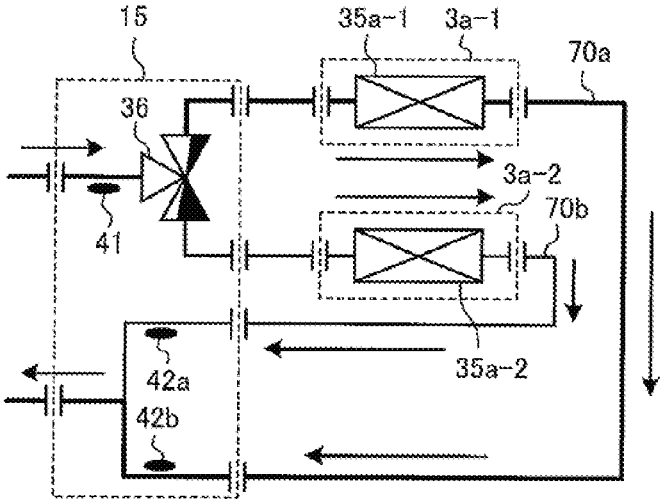
FIG. 9 is a diagram (Part 3) showing an opening degree image of the heat medium distribution regulating valve 36 of the heat medium distribution device 15 of the air-conditioning apparatus according to Embodiment of the present invention.

FIG. 9 is a diagram showing an opening degree image of the heat medium distribution regulating valve 36 of the heat medium distribution device 15 of the air-conditioning apparatus according to Embodiment of the present invention. In FIG. 9, the filled portions of the heat medium distribution regulating valve 36 mean closures inside the opening ports. In the case of FIG. 9, the opening degree image represents a case where more than half of the heat medium having flowed into the heat medium distribution device 15 flows into the use-side heat exchanger 35*a*-1 and less than half of the heat medium flows into the use-side heat exchanger 35*a*-2. That is, the opening degree image means there is a larger load on the use-side heat exchanger 35*a*-1 and there is only a small load on the use-side heat exchanger 35*a*-2. This control can be achieved by applying (Formula 1) to (Formula 8) to the heat medium distribution regulating valve 36.

While the control can be achieved by the controller 50 of the relay unit 2, it can alternatively be achieved by the heat medium distribution device 15 per se including a controller.

As described above, Embodiment provides the heat medium cycle circuit B with the heat medium distribution device 15 and thereby makes it possible to control the flow rate of the heat medium with respect to each of the plurality of use-side heat exchangers 35*a*-1 and 35*a*-2 connected to a single circuit of the heat medium cycle circuit B. This makes it possible to convey the heat medium to the use-side heat exchangers 35*a*-1 and 35*a*-2 at optimum flow rates according to the respective heat loads of the use-side heat exchangers 35*a*-1 and 35*a*-2. This prevents conveyance of more or less of the heat medium than necessary for the use-side heat exchangers. As a result, in the heat medium pipes 5, there is no need to take measures, for example, to execute works on heat medium conveying pipes in consideration of losses of pressures in the pipes or to provide the heat medium pipes 5 with valves for pressure loss control or similar devices.

Further, the control of the heat medium distribution device 15, or specifically the control of the heat medium distribution regulating valve 36, is performed on the basis of the temperature difference between the temperatures of the heat medium at the inlet and outlet of each of the use-side heat exchangers 35*a*-1 and 35*a*-2, and the heat medium distribution device 15 includes the temperature sensor 41 and the temperature sensors 42*a* and 42*b* to detect the temperature difference. For this reason, temperature sensors that perform temperature detection needed to control the heat medium distribution regulating valve 36 can be incorporated simply by incorporating the heat medium distribution device 15 into an existing air-conditioning apparatus.

It should be noted that the temperature sensor 41 and the temperature sensors 42*a* and 42*b* of the heat medium distribution device 15 are not the only temperature sensors that perform temperature detection needed to control the heat medium distribution regulating valve 36 and may be uneventfully substituted with the temperature sensors of the relay unit 2 or temperature sensors mounted in the indoor units 3, provided the control of (Formula 1) to (Formula 8) can be achieved. Note, however, that it is preferable, in view of control accuracy, that the temperature sensors of the heat medium distribution device 15 be used, as the temperature sensors of the heat medium distribution device 15 are more physically proximate to the use-side heat exchangers 35*a*-1 and 35*a*-2 than those of the relay unit 2.

It should be noted that although the foregoing description has been given by taking, as an example, a case where the second refrigerant flow switching devices 28 are four-way valves, this does not imply any limitation and the second refrigerant flow switching devices 28 may be configured by a plurality of two-way flow switching valves or three-way flow switching valves to allow refrigerant to flow in a similar manner.

Further, there is of course no problem even if a plurality of devices that function as intermediate heat exchangers 25 and expansion devices 26 are installed.

Further, although the foregoing description has been given by taking, as an example, a case where the heat medium flow control devices 34 are built in the relay unit 2, this does not imply any limitation. That is, the heat medium flow control devices 34 may alternatively be built in the indoor units 3. If the indoor units 3 have heat medium flow control functions, the heat medium flow control devices 34 do not need to be built in the heat medium distribution device 15, the relay unit 2, or the indoor units 3.

Although the air-conditioning apparatus 100 has been described by taking, as an example, a configuration in which the accumulator 19 is mounted, the accumulator 19 does not need to be mounted. Further, although, in general, the heat source side heat exchanger 12 and the use-side heat exchangers 35 have air-sending devices attached thereto and often facilitate condensation or evaporation by sending air, this does not imply any limitation. Examples of the usable use-side heat exchangers 35 are radiant panel heaters or similar devices. Further, an example of the usable heat source side heat exchanger 12 is a water-cooled heat exchanged that transfers heat through water or antifreeze. That is, any types of heat source side heat exchanger 12 and use-side heat exchanger 35 can be used, provided they are structured to be able to reject heat or remove heat.

The foregoing has illustrated (a total of four) configurations in which the four use-side heat exchangers 35*a* to 35*d* are provided as the use-side heat exchangers 35 and the four heat medium flow control devices 34*a* to 34*d* are provided for the use-side heat exchangers 35*a* to 35*d*, respectively. Further, the foregoing has illustrated a configuration in which the heat medium distribution device 15 is connected to a downstream side of the single heat medium flow control device 34*a* and, furthermore, the two use-side heat exchangers 35*a*-1 and 35*a*-2 are connected to the downstream side of the heat medium distribution device 15. The present invention is not limited to these example configurations. There need only be one or more use-side heat exchangers for each of the heat medium flow control devices 34 and there need only be two or more use-side heat exchangers for the heat medium distribution device 15.

Further, although the foregoing description has been given by taking, as an example, a case where there are two intermediate heat exchangers 25, this does not imply any limitation. Any number of intermediate heat exchangers 25 may be installed, provided they are configured to be able to cool and/or heat the heat medium. Furthermore, the number of pumps 31*a* and the number of pumps 31*b* are each not limited to 1, and a plurality of small-capacity pumps may be connected in parallel.

Further, although the heat medium distribution regulating valve 36 of the heat medium distribution device 15 has been shown to be a three-way valve whose opening degree can be controlled so that flow rates can be optimally controlled for the use-side heat exchangers 35*a*-1 and 35*a*-2 located on a downstream side of the heat medium distribution regulating valve 36. For example, the heat medium distribution regulating valve 36 may be a combination of a three-way valve for flow switching and an opening degree control valve that is capable of flow control. In this way, any type of heat medium distribution regulating valve 36 can be used, provided it is structured to be able to cause the heat medium to diverge into flows that go at optimally-controlled flow rates to the use-side heat exchangers 35*a*-1 and 35*a*-2 located on the downstream side of the heat medium distribution regulating valve 36.

Further, examples of the usable heat medium include, brine, which is antifreeze, water, a liquid mixture of brine and water, a liquid mixture of water and a highly anticorrosive additive, and similar liquids. That is, by adopting any of these as the heat medium, the air-conditioning apparatus 100 contributes to improvement in safety against leakage of the heat medium into the indoor space 7.

The invention claimed is:

1. An air-conditioning apparatus comprising:

a refrigerant cycle circuit through which heat source side refrigerant circulates, the refrigerant cycle circuit being constituted by connecting a compressor, a heat source side heat exchanger, an expansion device, and refrigerant side flow passages of a plurality of intermediate heat exchangers through refrigerant pipes;

a plurality of heat medium cycle circuits through which a heat medium circulates, the plurality of heat medium cycle circuits being constituted by heat medium side flow passages of the plurality of intermediate heat exchangers, a plurality of heat medium conveying devices, and a plurality of use-side heat exchangers through heat medium pipes;

a plurality of heat medium flow switching devices each of which being provided for each separate one of the plurality of heat medium cycle circuits, the heat medium flow switching devices configured to switch flow passages of the heat medium so that each of the use-side heat exchangers is connected to any of the plurality of intermediate heat exchangers; and a heat medium distribution device provided in a first heat exchanger of the plurality of heat medium cycle circuits circuit to which a plurality of the use-side heat exchangers are connected, the heat medium distribution device being configured to control flow rates of the heat medium of the plurality of use-side heat exchangers connected to the first heat medium cycle circuit, and a controller configured to control the heat medium distribution device, the controller being configured to cause the heat medium to flow in each of the plurality of heat medium cycle circuits at a flow rate according to a sum of a heat load of at least one use-side heat exchanger connected to the corresponding heat medium cycle circuit among the plurality of use-side heat exchangers, and to control the heat medium distribution device such that the heat medium flowed in the first heat medium cycle circuit flows in each of the plurality of use-side heat exchangers at a flow rate according to a heat load for each of the plurality of use-side heat exchangers of the first heat medium cycle circuit.

2. The air-conditioning apparatus of claim 1, further comprising a temperature detecting device configured to detect a difference between temperatures of the heat medium at an inlet and an outlet of each of the plurality of use-side heat exchangers in the first heat medium cycle circuit, wherein the controller is configured to control the heat medium distribution device based on the difference detected by the temperature detecting device.

3. The air-conditioning apparatus of claim 2, wherein the temperature detecting device is provided in the heat medium distribution device.

4. The air-conditioning apparatus of claim 1, wherein the heat medium distribution device includes a heat medium distribution regulating valve that controls the flow rates of the heat medium of the plurality of use-side heat exchangers by causing the heat medium of the heat medium cycle circuit to diverge into a plurality of flows at a given diverging ratio.

5. The air-conditioning apparatus of claim 1, further comprising:

an outdoor unit mounted with the compressor, the heat source side heat exchanger, and the expansion device;

a relay unit mounted with the plurality of intermediate heat exchangers, the plurality of heat medium conveying devices, and the plurality of heat medium flow switching devices; and a plurality of indoor units mounted with the use-side heat exchangers.

6. The air-conditioning apparatus of claim 5, further comprising a temperature detecting device provided in the relay unit or the indoor units, and configured to detect a difference between temperatures of the heat medium at an inlet and an outlet of each of the plurality of use-side heat exchangers in the first heat medium cycle circuit, wherein the controller is configured to control the heat medium distribution device based on the difference detected by the temperature detecting device.

7. The air-conditioning apparatus of claim 5, wherein the heat medium distribution device includes a first connecting port where the heat medium distribution device is connected to the relay unit, a second connecting port where the heat medium distribution device is connected to the plurality of indoor units, a distribution pipe that allows the heat medium from the relay unit entered through an inlet side connecting port of the first connecting port to diverge into flows and guides the flows to a plurality of outlet side connecting ports of the second connecting port, and a converging pipe that allows the heat medium from each of the indoor units entered through a plurality of inlet side connecting ports of the second connecting port to converge and guides the heat medium to an outlet side connecting port of the first connecting port.

8. The air-conditioning apparatus of claim 1, wherein the refrigerant cycle circuit further includes a refrigerant flow switching device configured to perform a cooling operation and a heating operation by switching flows of the heat source side refrigerant discharged from the compressor.

* * * * *